US011466446B1

(12) United States Patent
Suprina

(10) Patent No.: US 11,466,446 B1
(45) Date of Patent: Oct. 11, 2022

(54) QUICK-ASSEMBLE CONSTRUCTION SYSTEM AND FREESTANDING SEATING SYSTEM UTILIZING SAME

(71) Applicant: InProduction, Inc., Naperville, IL (US)

(72) Inventor: Scott F. Suprina, East Northport, NY (US)

(73) Assignee: Inproduction, Inc., Naperville, IL (US)

( * ) Notice: Subject to any disclaimer, the term of this patent is extended or adjusted under 35 U.S.C. 154(b) by 49 days.

(21) Appl. No.: 16/725,336

(22) Filed: Dec. 23, 2019

Related U.S. Application Data

(60) Provisional application No. 62/785,573, filed on Dec. 27, 2018.

(51) Int. Cl.
*E04B 1/41* (2006.01)
*E04C 3/32* (2006.01)
*E04B 1/38* (2006.01)

(52) U.S. Cl.
CPC ..... *E04B 1/40* (2013.01); *E04C 3/32* (2013.01); *E04B 2001/405* (2013.01)

(58) Field of Classification Search
CPC ..... E04B 1/40; E04B 2001/405; E04C 3/32
See application file for complete search history.

(56) References Cited

U.S. PATENT DOCUMENTS 2,990,203 A * 6/1961 Grover ..... F16B 7/0446 403/174
3,268,252 A * 8/1966 Rolland ..... E04B 1/58 403/296
3,507,121 A * 4/1970 Morfeldt ..... E04H 12/20 405/259.5
3,656,269 A * 4/1972 Witschel ..... E04G 11/48 52/638
3,684,058 A * 8/1972 Brown ..... E04G 1/14 182/132
3,771,753 A * 11/1973 Wilbur ..... E04G 17/16 248/295.11
4,036,371 A * 7/1977 Michel ..... F16B 12/02 211/182
4,260,276 A * 4/1981 Phillips ..... E04B 1/2403 403/172
4,379,649 A * 4/1983 Phillips ..... E04B 1/1909 403/172
4,432,661 A * 2/1984 Phillips ..... E04B 1/3211 403/172
4,462,197 A * 7/1984 DAIessio ..... E04G 1/12 182/178.5
4,481,748 A * 11/1984 DAIessio ..... E04G 11/48 182/178.5
4,484,430 A * 11/1984 Rossman ..... E04B 1/1909 403/174

(Continued)

*Primary Examiner* — James M Ference
(74) *Attorney, Agent, or Firm* — Nutter McClennen & Fish LLP

(57) ABSTRACT

Exemplary embodiments relate to a quick-assemble construction system that includes various components that can be positioned and interconnected quickly and later adjusted and tightened. The quick-assemble construction system was envisioned specifically for freestanding seating systems that can be quickly installed and removed if needed, although the quick-assemble construction system can be used in a wider range of applications and is not limited to seating systems.

20 Claims, 22 Drawing Sheets

(56) References Cited

U.S. PATENT DOCUMENTS 4,566,818 A * 1/1986 Schwartz ..... E04B 1/5843 403/172
4,577,449 A * 3/1986 Celli ..... E04B 1/2403 403/191
4,867,274 A * 9/1989 Langer ..... E04G 7/307 182/186.8
4,904,108 A * 2/1990 Wendel ..... E04B 1/1912 403/170
5,289,665 A * 3/1994 Higgins ..... E04B 1/2403 211/191
5,356,234 A * 10/1994 Vangool ..... E04B 1/1903 403/170
5,867,961 A * 2/1999 Castano ..... E04B 1/1903 52/653.1
5,924,258 A * 7/1999 Castano ..... E04B 1/19 52/653.1
5,964,546 A * 10/1999 Castano ..... E04B 1/1909 403/174
5,970,679 A * 10/1999 Amore ..... E04B 1/2403 52/846
6,009,914 A * 1/2000 Castano ..... E04B 1/1903 138/109
6,237,298 B1 * 5/2001 Castano ..... E04B 1/3211 403/170
6,286,282 B1 * 9/2001 Castano ..... E04B 1/3211 403/171
6,321,502 B1 * 11/2001 Castano ..... E04B 1/3211 403/171
6,754,992 B1 * 6/2004 Byfield ..... E04B 1/2403 403/205
6,802,169 B2 * 10/2004 Simmons ..... E04B 1/24 52/648.1
6,814,184 B1 * 11/2004 Blinn, Jr. ..... E04G 1/08 182/141
7,146,770 B2 * 12/2006 Simmons ..... E04B 1/2403 52/236.6
7,823,347 B1 * 11/2010 Blinn ..... E04C 3/08 52/244
8,161,707 B2 * 4/2012 Simmons ..... E04C 3/32 52/648.1
8,615,960 B2 * 12/2013 Marcotte ..... E21B 15/00 52/655.1
10,119,265 B2 * 11/2018 Higgins ..... E04B 1/2608
2003/0159368 A1 * 8/2003 Osterberg ..... E04B 1/1906 52/81.3
2003/0172612 A1 * 9/2003 Simmons ..... E04B 1/24 52/648.1
2005/0040312 A1 * 2/2005 Tsai ..... E04F 15/02458 248/618
2005/0055969 A1 * 3/2005 Simmons ..... E04B 1/24 52/831
2006/0265992 A1 * 11/2006 Hiragaki ..... E04B 5/43 52/633
2007/0197082 A1 * 8/2007 Zeh ..... E04B 2/7433 439/404
2007/0274771 A1 * 11/2007 Chang ..... E04G 7/32 403/187
2007/0289230 A1 * 12/2007 Schroeder, Sr. ..... E04H 9/14 52/149
2008/0184633 A1 * 8/2008 Hamilton ..... E04H 12/2261 52/127.12
2010/0005752 A1 * 1/2010 Hawkins ..... E04B 1/1909 52/655.1
2010/0205875 A1 * 8/2010 Rawson-Harris ... G09F 15/0037 52/126.7
2013/0074430 A1 * 3/2013 Morcous ..... E04B 5/265 52/252
2014/0259993 A1 * 9/2014 Hayes ..... F16B 5/0266 52/167.1
2015/0023726 A1 * 1/2015 Thacker ..... E04G 7/32 403/49
2015/0167290 A1 * 6/2015 Puritani ..... E04B 1/2403 52/650.1
2016/0097192 A1 * 4/2016 Marquina ..... E04B 1/24 52/655.1
2016/0265217 A1 * 9/2016 Hayes ..... E04H 9/024
2016/0376756 A1 * 12/2016 Von Handorf ..... E01D 21/00 405/125
2018/0135321 A1 * 5/2018 Francis ..... E04H 3/126

* cited by examiner

QUICK-ASSEMBLE CONSTRUCTION SYSTEM AND FREESTANDING SEATING SYSTEM UTILIZING SAME

CROSS-REFERENCE TO RELATED APPLICATION(S)

This patent application claims the benefit of U.S. Provisional Patent Application No. 62/785,573 entitled QUICK-ASSEMBLE CONSTRUCTION SYSTEM AND FREESTANDING SEATING SYSTEM UTILIZING SAME filed Dec. 27, 2018, which is hereby incorporated herein by reference in its entirety.

FIELD OF THE INVENTION

The invention generally relates to a quick-assemble construction system that includes various components that can be positioned and interconnected quickly and later adjusted and tightened.

BACKGROUND OF THE INVENTION

Many temporary construction systems are relatively simple and are easy to transport and install. For example, many temporary seating systems such as temporary bleachers and similar seating systems include pre-formed seating sections and simple base structures.

SUMMARY OF VARIOUS EMBODIMENTS

In accordance with one embodiment of the invention, apparatus for a freestanding construction system comprises a support structure such as a square or round column and at least one rod cross-brace bracket on the support structure (e.g., two rod cross-brace brackets on opposing sides of the support structure), each rod cross-brace bracket including a keyed slot configured to receive a key portion of a threaded rod cross-brace member.

The apparatus also may include at least one solid cross-brace bracket on the support structure (e.g., two solid cross-brace brackets on opposing sides of the support structure), where each rod cross-brace bracket may include an angle bracket.

The apparatus also may include a base plate attached to the support structure, wherein the support structure is a column support configured to receive a column. The column support may be configured to support a square column or a round column. The column support may include at least one notch configured to allow insertion of a shim under a column. The column support may include at least one adjustment nut into which a bolt can be threaded in order to secure the column in the column support.

The apparatus also may include two lateral vertical plates on the column configured to interface with a beam having a longitudinal rod configuration. Each vertical plate may include at least one hole for attaching the beam to the vertical plates. The column may include a horizontal plate on the column for at least one of (a) supporting the beam or (b) attaching the beam to the horizontal plate.

The apparatus also may include two lateral vertical plates on the column configured to interface with a beam having a lateral rod configuration. The column also may include a central vertical plate on the column between the two lateral vertical plates, the central vertical plate including holes for attaching the beam to the central vertical plate. The column may include a horizontal plate on the column for at least one of (a) supporting the beam or (b) attaching the beam to the horizontal plate.

In accordance with another embodiment of the invention, apparatus for a freestanding construction system comprises a beam and at least one of a longitudinal rod configuration on the beam or a lateral rod configuration on the beam. The longitudinal rod configuration on the beam is configured to interface with two lateral vertical plates on a column configured to interface with the longitudinal rod configuration, the longitudinal rod configuration comprising a first angle bracket attached to a first side of the beam, a first longitudinal rod attached to the first angle bracket, a second angle bracket attached to a second side of the beam opposite the first side, and a second longitudinal rod attached to the second angle bracket. The lateral rod configuration on the beam is configured to interface with two lateral vertical plates on a column configured to interface with the lateral rod configuration, the lateral rod configuration comprising a first lateral rod attached to a first side of the beam and a second lateral rod attached to a second side of the beam opposite the first side.

The longitudinal rod configuration also may include a first end bracket attached to the first side of the beam and a second end bracket attached to the second side of the beam, wherein each end bracket includes at least one hole for attaching the end bracket to a corresponding lateral vertical plate on a column.

Additional embodiments may be disclosed and claimed.

BRIEF DESCRIPTION OF THE DRAWINGS

Those skilled in the art should more fully appreciate advantages of various embodiments of the invention from the following "Description of Illustrative Embodiments," discussed with reference to the drawings summarized immediately below.

It should be noted that the foregoing figures and the elements depicted therein are not necessarily drawn to consistent scale or to any scale. Unless the context otherwise suggests, like elements are indicated by like numerals.

DESCRIPTION OF ILLUSTRATIVE EMBODIMENTS

Definitions. As used in this description and the accompanying claims, the following terms shall have the meanings indicated, unless the context otherwise requires.

The term "threaded rod" generally refers to a rod or similar structure that has threading on at least a portion of a surface such as for receiving a correspondingly threaded nut or other hardware. Generally, a threaded rod will have threading on at least one end and typically on both ends. A threaded rod is not required to have threading along its entire length. Two threaded rods can be configured to be interconnected using a turnbuckle or other hardware.

Exemplary embodiments relate to a quick-assemble construction system that includes various components that can be positioned and interconnected quickly and later adjusted and tightened. The quick-assemble construction system was envisioned specifically for freestanding seating systems that can be quickly installed and removed if needed, although the quick-assemble construction system can be used in a wider range of applications and is not limited to seating systems.

One exemplary seating system includes three tiers. Without limitation, the lowest (bottom) tier might be used for retail space or concessions (not shown), the middle tier might be used for press or luxury boxes (not shown), and the top tier is configured for bleacher-type seating. As described in greater detail below, the seating system is built from four main types of components, namely pedestal bases, columns that fit into the pedestal bases, beams that are held in place by the columns, and cross-braces that help to secure the columns. The pedestal bases, columns, beams and cross-braces include innovative features that allow for quick assembly, specifically by allowing the pedestal bases, columns, beams, and cross-braces to be quickly positioned and secured in a temporary manner and later adjusted and tightened to provide a strong structure. The various components can be configured in many different ways to allow for a wide variety of structures and seating systems.

Figure 1:
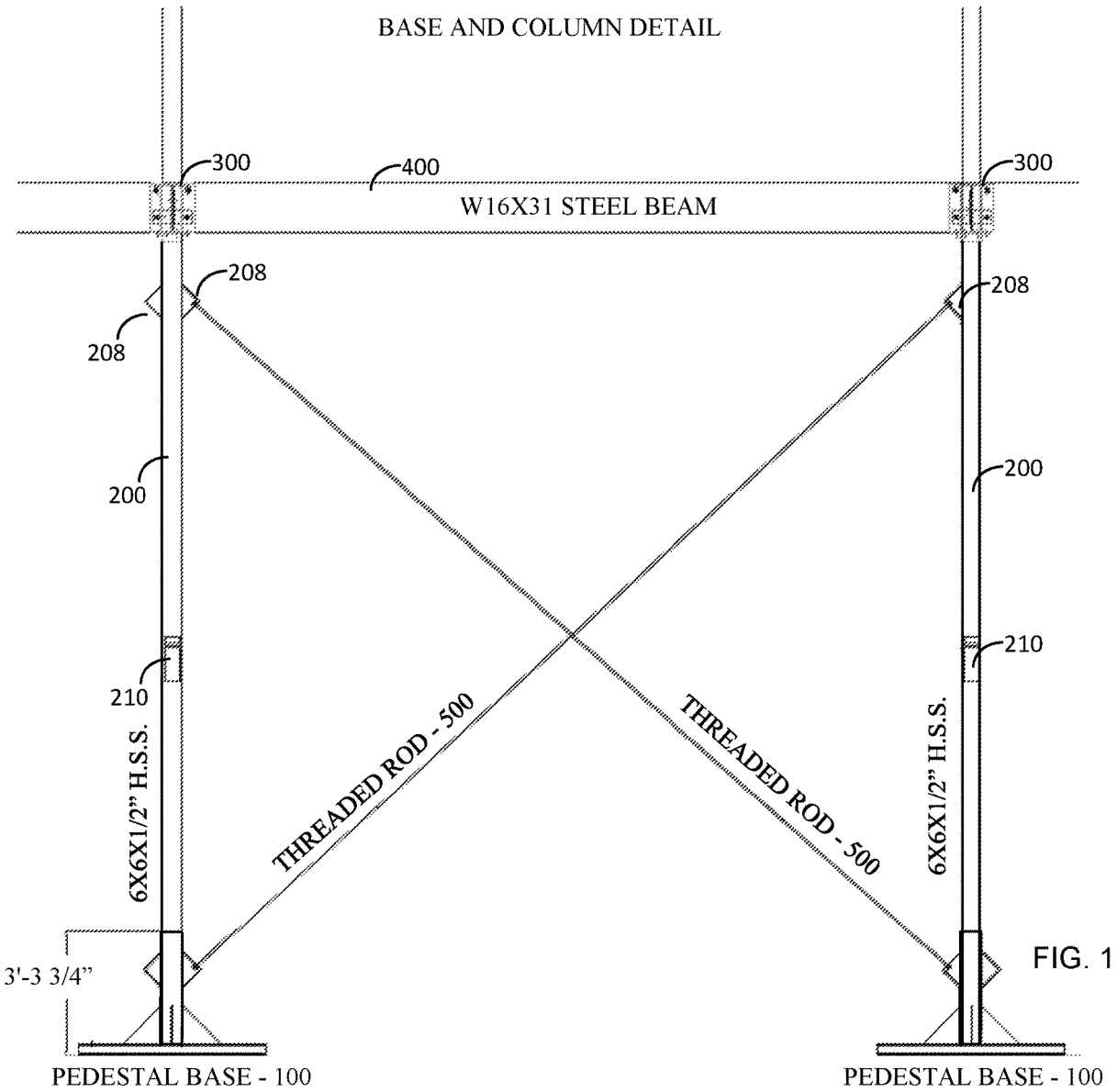
FIG. 1 is a schematic diagram showing some exemplary relationships between the components of a quick-assembly construction system, in accordance with one exemplary embodiment.

FIG. 1 is a schematic diagram showing some exemplary relationships between the components, in accordance with one exemplary embodiment. Here, two pedestal bases 100 hold two columns 200, with threaded rod cross-bracing 500 used to secure the columns 200, and a steel beam 400 secured by the two columns 200 via special connections 300. As described in greater detail below, the pedestal bases 100 and columns 200 are configured to also support cross-bracing in directions normal to the plane of the page so that, for example, four pedestal bases and four columns can be used to form a rectangular (e.g., square) structure that is cross-braced on all four sides. In certain exemplary embodiments, the cross-bracing in the normal directions utilizes solid cross-brace members rather than threaded rods, although threaded rods could be used in some alternative embodiments. In the exemplary embodiment shown in FIG. 1, the columns are square and have cross-brace brackets on all four sides, although the columns could be round or other shapes in various alternative embodiments and can include any number of cross-brace brackets as necessary or desirable for a given implementation.

Figure 2:
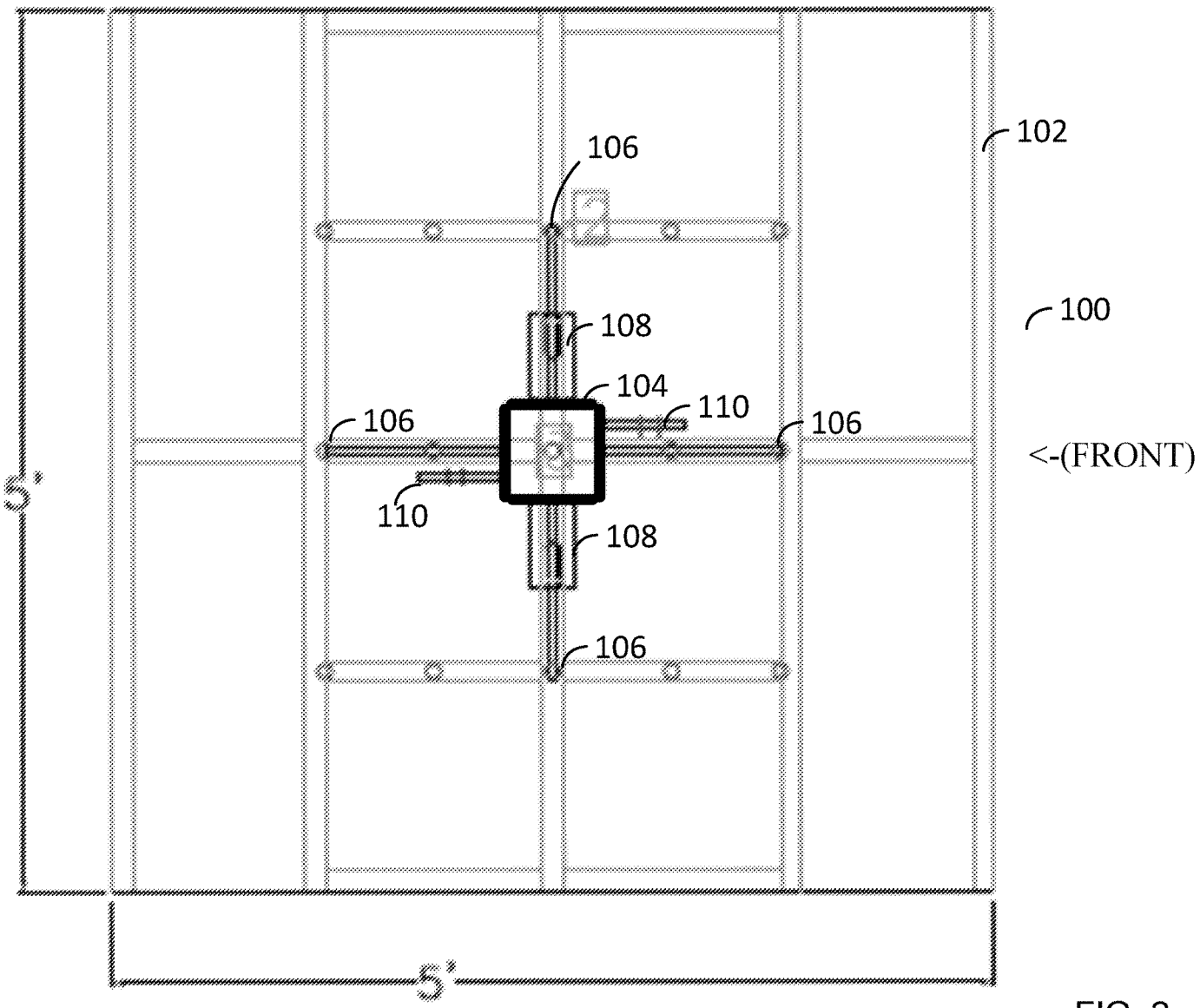
FIG. 2 is a schematic diagram showing a top-down view of a pedestal base 100, in accordance with one exemplary embodiment.

FIG. 2 is a schematic diagram showing a top-down view of a pedestal base 100, in accordance with one exemplary embodiment. Among other things, the pedestal base 100 includes a base plate 102, a column support 104, four gusset plates 106 to support the column support 104, two rod cross-brace brackets 108 on opposite sides of the column support 104, and two solid cross-brace brackets 110 on the remaining two sides of the column support 104.

Figure 3:
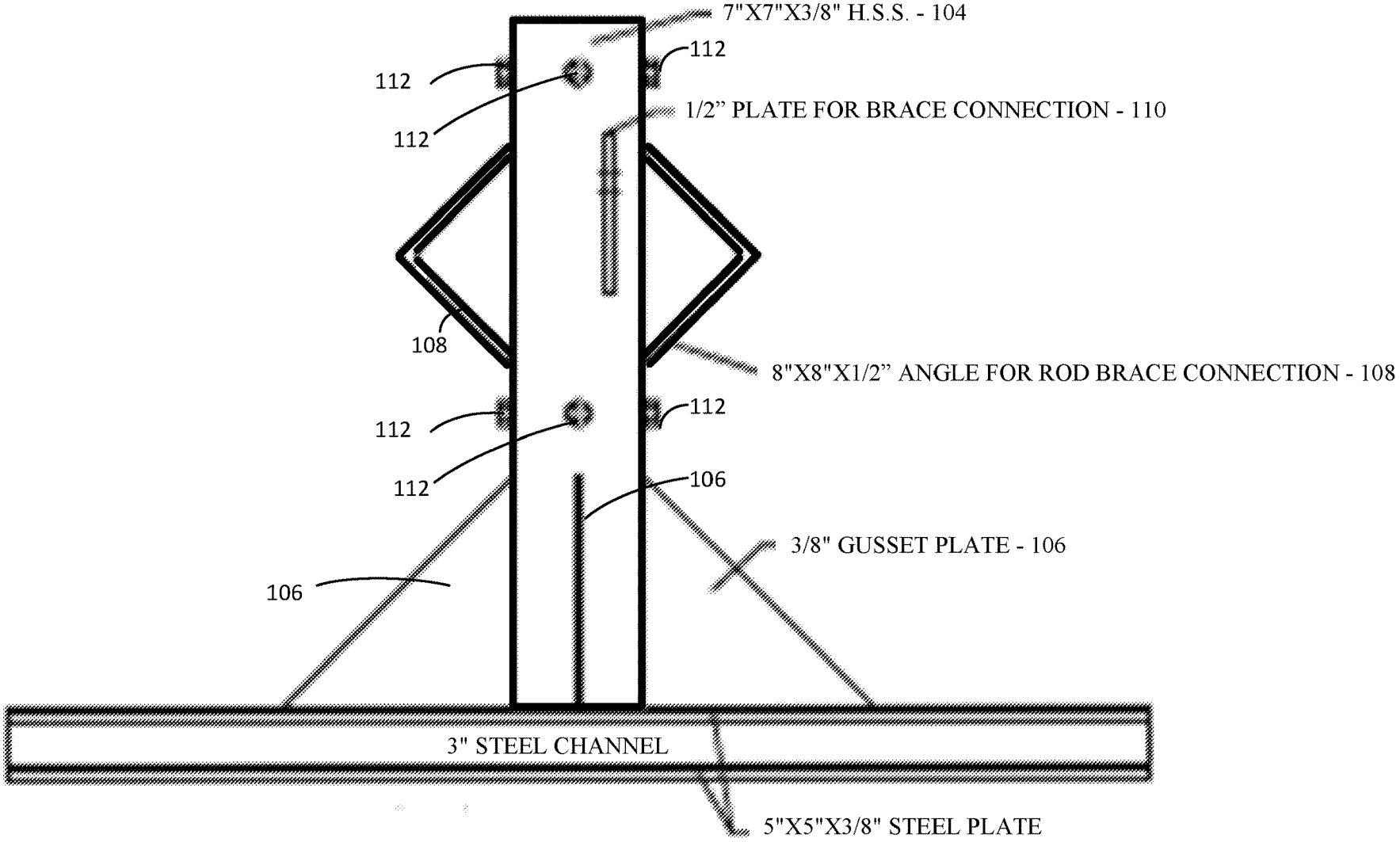
FIG. 3 is a schematic diagram showing a front side view of the pedestal base 100, in accordance with one exemplary embodiment.

FIG. 3 is a schematic diagram showing a front side view of the pedestal base 100, in accordance with one exemplary embodiment. Here, the pedestal base 100 is oriented as depicted in FIG. 1. Shown here is the base plate 102, the column support 104, three of the gusset plates 106, the two rod cross-brace brackets 108 on opposite sides of the column support 104, one of the solid cross-brace brackets 110, and six of eight adjustment nuts into which bolts can be threaded in order to secure the column 200 in the column support 104. It should be noted that the back side view of the pedestal base 100 (not shown) is virtually identical to the front side view in this exemplary embodiment.

Figure 4:
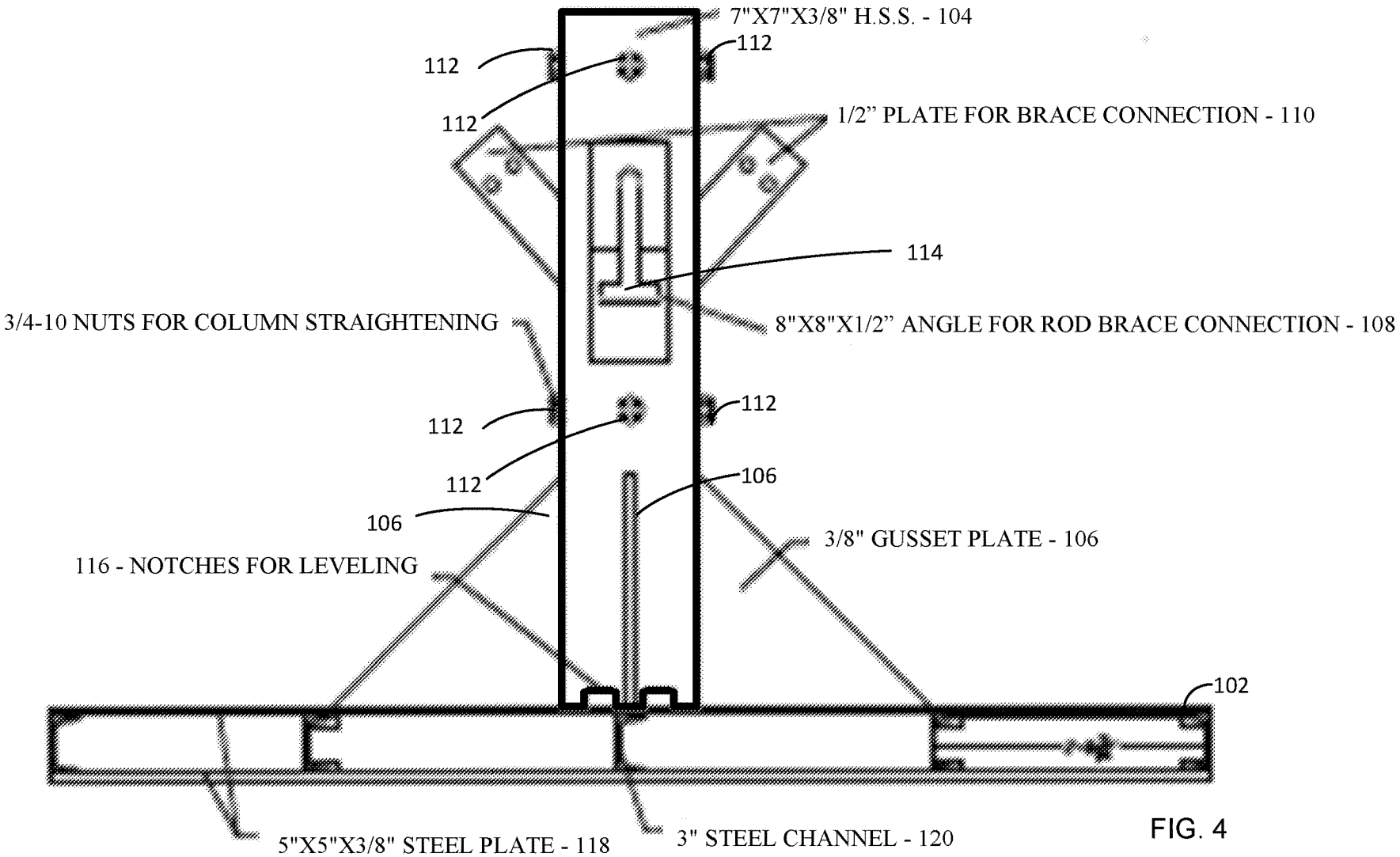
FIG. 4 is a schematic diagram showing a right side view of the pedestal base 100, in accordance with one exemplary embodiment.

FIG. 4 is a schematic diagram showing a right side view of the pedestal base 100, in accordance with one exemplary embodiment. Shown here is the base plate 102, the column support 104, three of the gusset plates 106, one of the two rod cross-brace brackets 108, the solid cross-brace brackets 110 on opposite sides of the column support 104, and six of eight adjustment nuts into which bolts can be threaded in order to secure the column 200 in the column support 104.

In this exemplary embodiment, each rod cross-brace bracket 108 includes a keyed slot 114 that allows the end portion of a threaded rod cross-brace (e.g., including a washer and nut or other terminal element, referred to herein as a "key") to be easily inserted into the rod cross-brace bracket 108 for temporary positioning of the threaded rod cross-brace and later tightening. In this exemplary embodiment, the key portion of the keyed slot 114 is on the bottom segment of the rod cross-brace bracket 108, which facilitates installation of a threaded rod cross-brace into the rod cross-brace bracket 108.

Returning to FIG. 1, the columns 200 include rod cross-brace brackets 208 similar to the rod cross-brace brackets 108 on the pedestal base 100 and positioned to receive the opposite end of a rod cross-brace. Like the rod cross-brace brackets 108, the column rod cross-brace brackets 208 include a keyed slot (not shown in FIG. 1). In this exemplary embodiment, the key portion of the keyed slot of the column rod cross-brace bracket 208 is on the top segment of the rod cross-brace bracket 208, which facilitates installation of a threaded rod cross-brace into the rod cross-brace bracket 208.

The columns 200 also include solid cross-brace brackets 210 similar to the solid cross-brace brackets 110 on the pedestal base 100 and positioned to receive the opposite end of a solid cross-brace.

Returning to FIG. 4, in this exemplary embodiment, the column support 104 includes notches 116 to allow for shims to be inserted under the column 200 if needed (additionally or alternatively, material can be placed inside the column support 104 if needed for additional height adjustment). In this exemplary embodiment, the base plate 102 is formed from top and bottom steel plates 118 interconnected by steel channels 120, although the base plate 102 can be formed in other ways in various alternative embodiments (e.g., solid steel). It should be noted that the left side view of the pedestal base 100 (not shown) is virtually identical to the right side view in this exemplary embodiment.

It should be noted that alternative versions of the pedestal base 100 may include different types and sizes of base plate 102, different numbers of rod cross-brace brackets 108 (or no rod cross-brace brackets 108), different numbers of solid cross-brace brackets 110 (or no solid cross-brace brackets 110), and other differences necessary or desirable for a given implementation. Different pedestal bases having different configurations can be used in a given implementation, e.g., some pedestal bases for an outside corner location might be configured to include only two cross-brace brackets on adjacent sides of the column support 104, while some pedestal bases for a middle location along a line of columns might be configured to include only two cross-brace brackets on opposite sides of the column support 104 or to include three cross-brace brackets in a "T" configuration depending on how such pedestal bases will be used in the given implementation. Pedestal bases can be configured to accommodate different shapes and sizes of columns.

Figure 5:
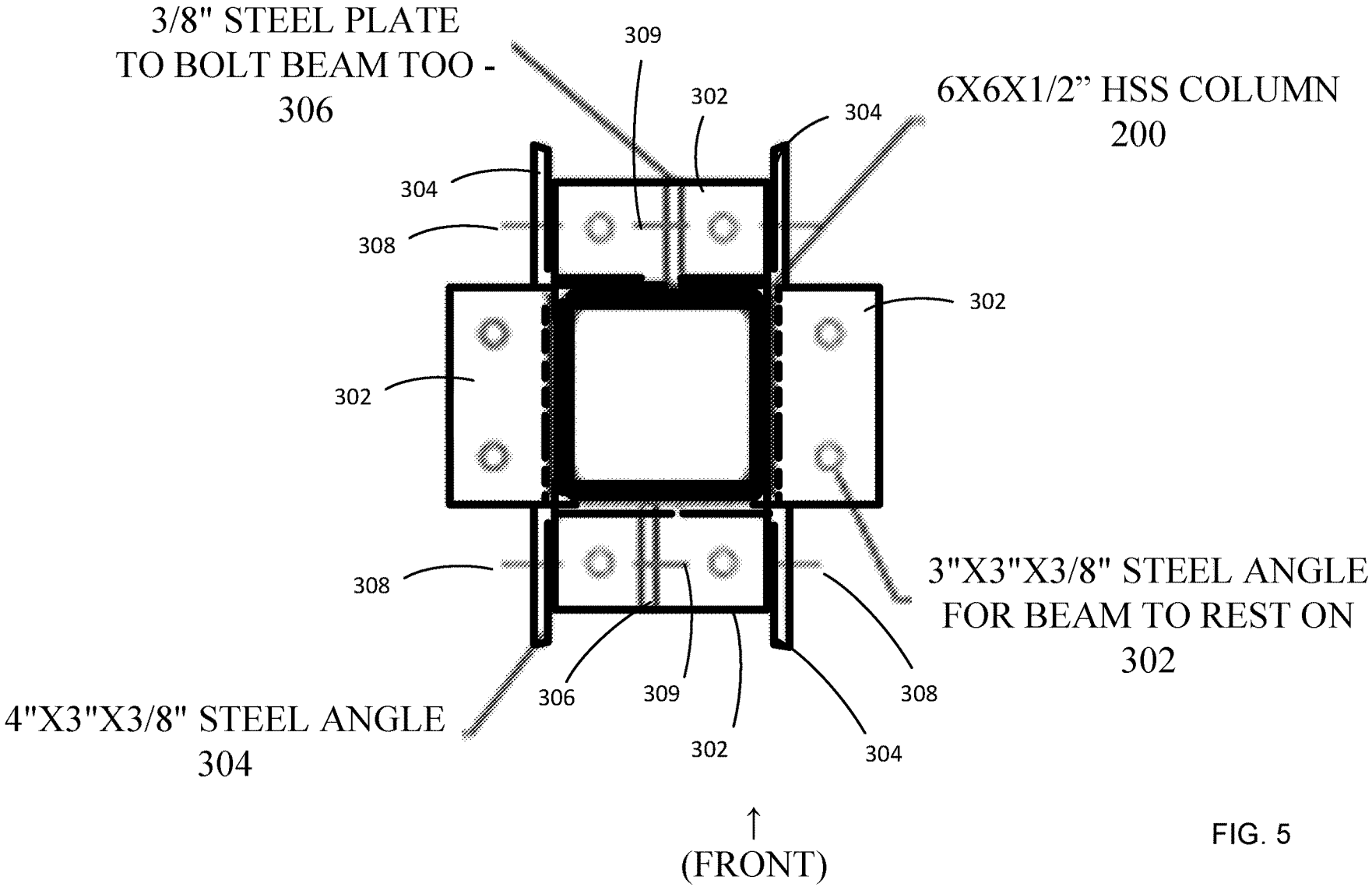
FIG. 5 is a schematic diagram showing a top view of the components on a column 200 used for making connections 300 with beams 400, in accordance with one exemplary embodiment.

FIG. 5 is a schematic diagram showing a top view of the components on a column 200 used for making connections 300 with beams 400, in accordance with one exemplary embodiment. Among other things, the components include four horizontal plates 302 onto which the beams 400 can be rested during positioning and later secured, e.g., using bolts. In this exemplary embodiment, each horizontal plate 302 is part of an angle bracket that is attached to the column 200. On each of two opposing sides of the column 200, above the level of the horizontal plates 302, are two lateral vertical plates 304 placed toward the edges of the column 200 and a central vertical plate 306. Each lateral vertical plate 304 has a vertical channel at location 308 (also referred to as vertical channel 308) extending downward from the top of the lateral vertical plate 304. As discussed in greater detail below, these channels are used to receive specially configured rods at the ends of the beams 400 to assist with positioning and later securing of the beams 400 onto the column 200. In this exemplary embodiment, each lateral vertical plate 304 is part of an angle bracket that is attached to the column 200, although the lateral vertical plates 304 could be attached in other ways, e.g., a U-shaped bracket including two of the lateral vertical plates 304 on the same side of the column 200, or a flat plate including two of the lateral vertical plates 304 on opposite sides of the column 200.

The horizontal plates 302 include holes through which bolts can be placed to secure the beams 400 onto the horizontal plates 302. The central vertical plates 306, which are offset from the center of the column 200 to allow beams 400 to be placed at the center, include holes at locations 309 (also referred to as holes 309) through which bolts can be placed to secure the beams 400 onto the central vertical plates 306. The lateral vertical plates 304 include holes through which bolts can be placed to secure certain beams 400 onto the lateral vertical plates.

Figure 6:
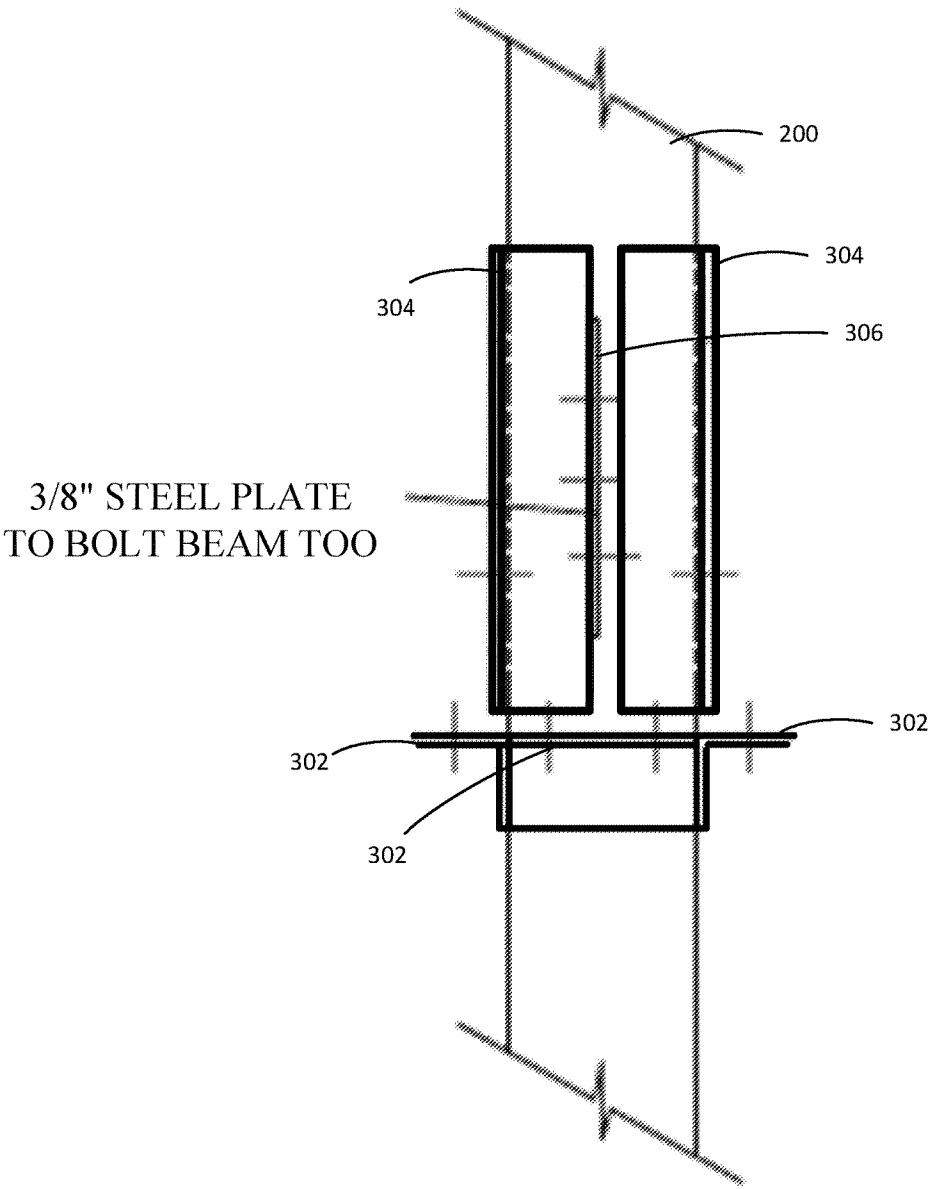
FIG. 6 is a schematic diagram showing a front side view of the components at the top of a column 200 used for making connections 300 with beams 400, in accordance with one exemplary embodiment.

FIG. 6 is a schematic diagram showing a front side view of the components at the top of a column 200 used for making connections 300 with beams 400, in accordance with one exemplary embodiment. Shown here are three of the horizontal plates 302 (each of which is part of an angle bracket), two lateral vertical brackets 304 (each of which is part of an angle bracket), and a central vertical bracket 306. It should be noted that the back side view of these components is virtually identical to the front side view in this exemplary embodiment.

Figure 7:
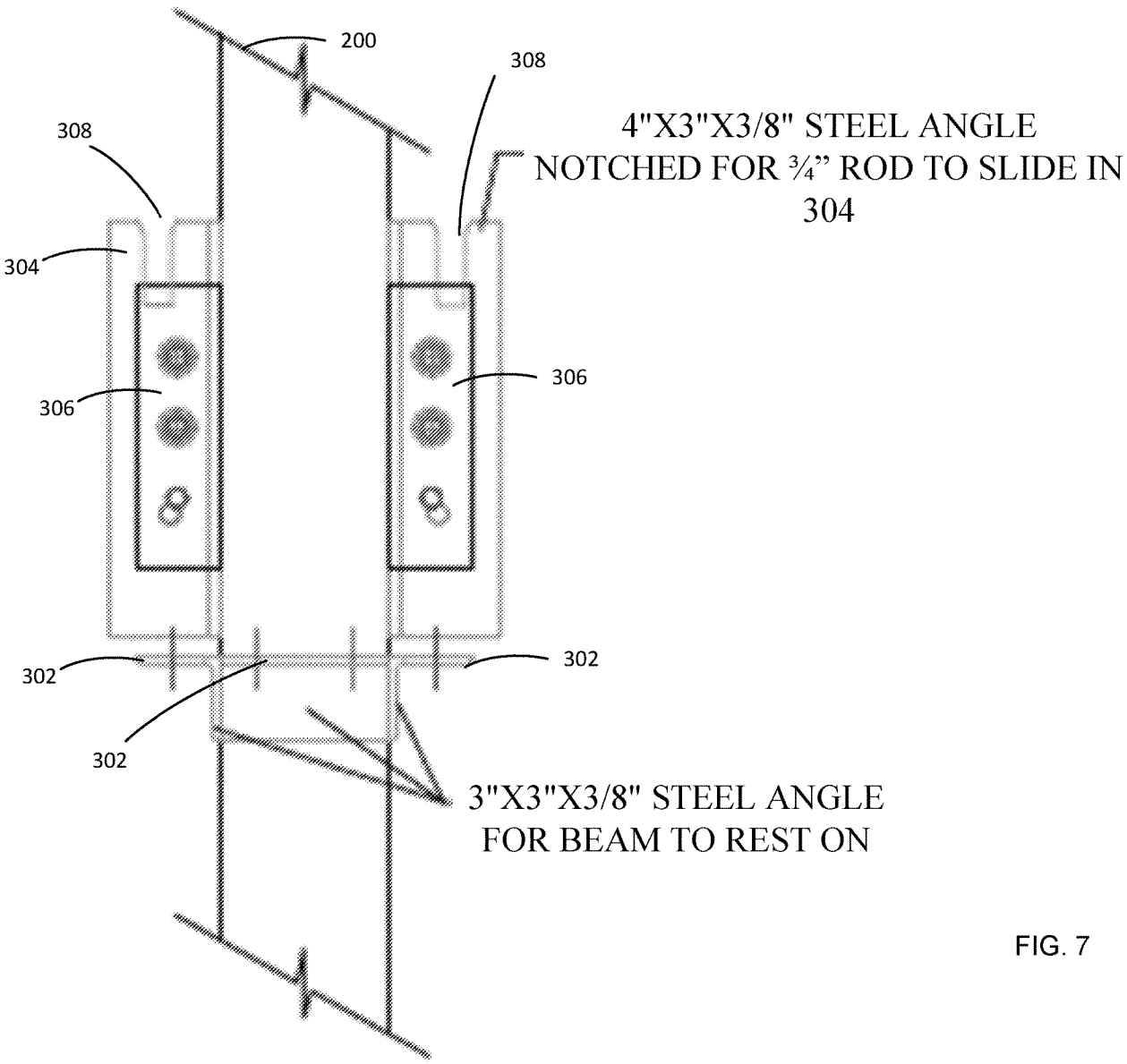
FIG. 7 is a schematic diagram showing a right side cross-sectional view of the components at the top of a column 200 used for making connections 300 with beams 400, in accordance with one exemplary embodiment.

FIG. 7 is a schematic diagram showing a right side cross-sectional view of the components at the top of a column 200 used for making connections 300 with beams 400, in accordance with one exemplary embodiment. Shown here are three of the horizontal plates 302 (each of which is part of an angle bracket), two of the lateral vertical brackets 304 (each of which is part of an angle bracket), and the central vertical brackets 306. The cross-section here is roughly at the central vertical plates 306 so that the relative positions of the central vertical plates 306 and the lateral vertical plates 304 can be appreciated. It should be noted that the left side view of these components is virtually identical to the right side view in this exemplary embodiment.

It should be noted that the column components shown and described with reference to FIGS. 5-7 can be placed at any position/height on a column 200, and a column 200 can include multiple sets of such components in order to support multiple beams 400 at different heights.

It should be noted that the column components of the type shown and described with reference to FIGS. 5-7 allow a column to support one, two, three, or four beams 400 in a given implementation. In some cases, some of the components can be omitted if a particular column is specifically configured to support only one, two, or three beams. For example, with reference to FIG. 5, a column can be configured to support a single beam 400 on the front or back side of the column 200, in which case the components 302/304/306 on the opposite side of the column as well as the horizontal brackets 302 on the right and left sides of the column could be omitted. Another column can be configured to support a single beam on the right or left side of the column, in which case the components 302/306 on the front and back sides of the column could be omitted. Another column can be configured to support beams on the front and back sides of the column, in which case the components 302 on the right and left sides of the column could be omitted. Another column can be configured to support beams on the right and left sides of the column, in which case the components 302/306 on the front and back sides of the column could be omitted. Other columns can be configured to support three beams, in which case any unused components could be omitted. It should be noted that in some embodiments, all of the horizontal plates 302 may be omitted, e.g., if the beam(s) to be supported by the column can be adequately positioned and supported by the lateral vertical plates 304 and optionally also the central vertical plates 306. Thus, at a minimum, a column used to support at least one beam will include at least two lateral vertical plates 304 positioned as needed for the beam to be supported.

Additionally or alternatively, different column assemblies having different numbers of rod cross-brace brackets 208 (or no rod cross-brace brackets 208) and/or different numbers of solid cross-brace brackets 210 (or no solid cross-brace brackets 210), and other differences necessary or desirable for a given implementation. For example, some columns for an outside corner location might be configured to include only two cross-brace brackets on adjacent sides of the column, while some columns for a middle location along a line of columns might be configured to include only two cross-brace brackets on opposite sides of the column or to include three cross-brace brackets in a "T" configuration depending on how such columns will be used in the given implementation. A given implementation might use columns having different shapes and/or sizes.

In order to connect with the components shown in FIGS. 5-7, two different beam 400 configurations are used, specifically a first configuration for coupling at the right and left sides of the column 200 and a second configuration for coupling at the front and back sides of the column 200.

Figure 8:
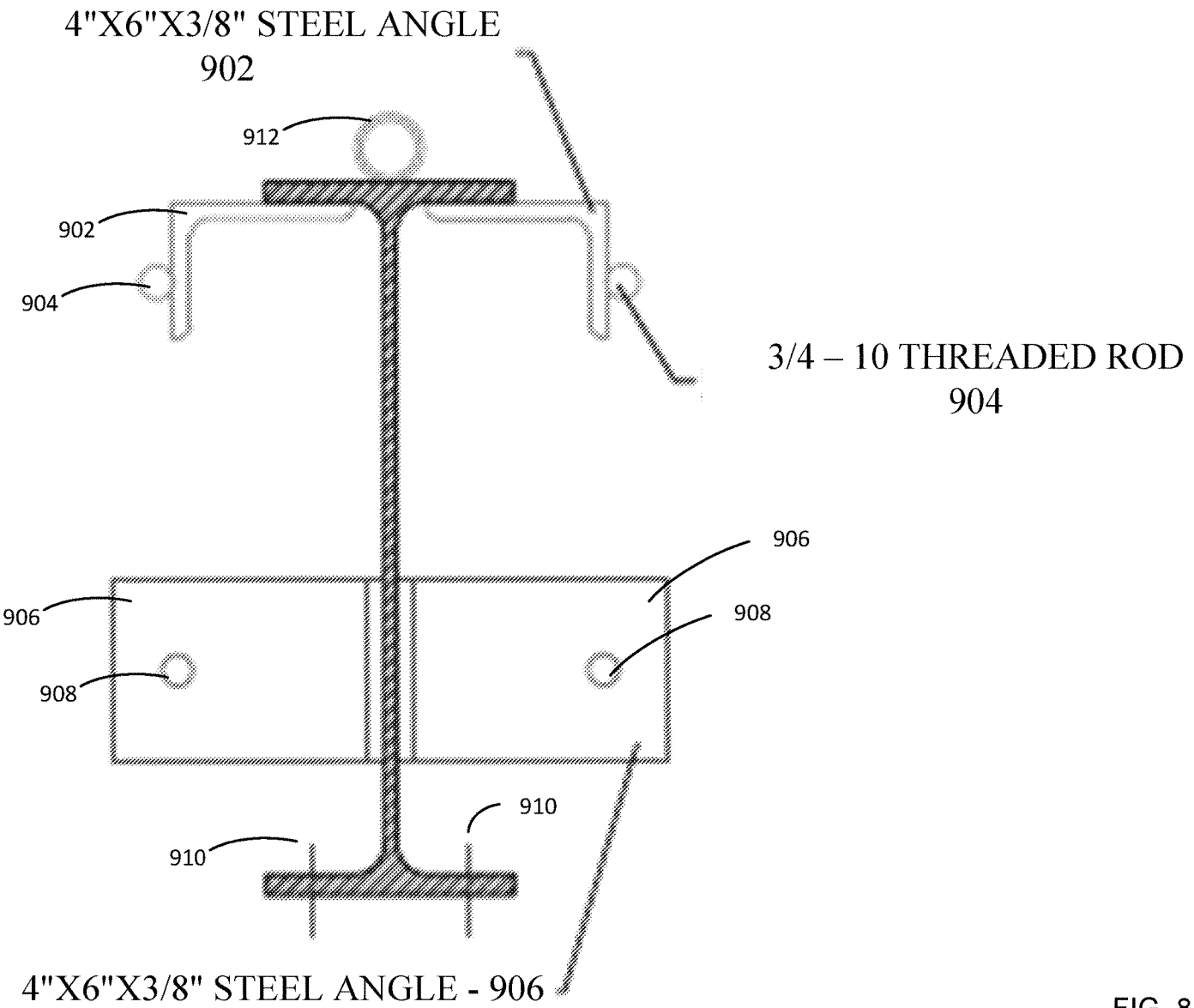
FIG. 8 is a schematic diagram showing an end view of a beam 400 having the first configuration (referred to herein as the longitudinal rod configuration), in accordance with one exemplary embodiment.

FIG. 8 is a schematic diagram showing an end view of a beam 400 having the first configuration (referred to herein as the longitudinal rod configuration), in accordance with one exemplary embodiment. Here, the beam 400 is an I-beam that includes two angle brackets 902. Onto each angle bracket 902 is attached a longitudinal threaded rod 904 that extends past the end of the beam 400. These longitudinal threaded rods 904 fit into the vertical channels 308 in a pair of lateral vertical brackets 304 in order to position and later secure the beam 400 onto the column 200. The beam 400 also includes end brackets 906 with holes 908 that align with corresponding holes in the pair of lateral vertical brackets 304 so that bolts can be placed through the holes for securing the beam 400 to the lateral vertical brackets 304. In this exemplary embodiment, each end bracket 906 is part of an angle bracket that is attached to the beam 400. The beam 400 also includes holes 910 that align with corresponding holes in a horizontal plate 302 so that bolts can be placed through the holes for securing the beam 400 to the horizontal plate 302. The element 912 is an optional rod on the beam 400.

Figure 9:
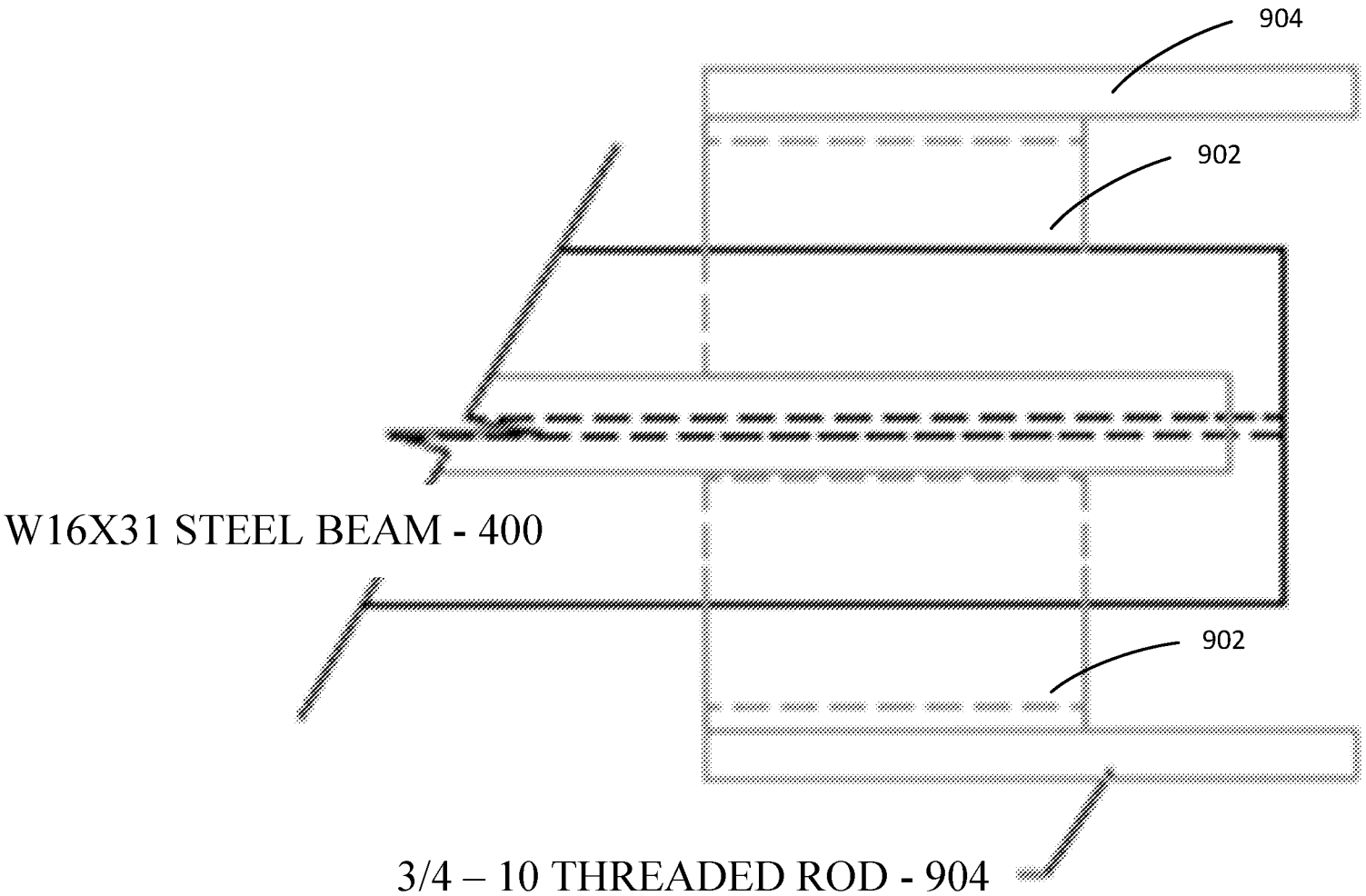
FIG. 9 is a schematic diagram showing a top view of the beam 400 of FIG. 8, in accordance with one exemplary embodiment.

FIG. 9 is a schematic diagram showing a top view of the beam 400 of FIG. 8, in accordance with one exemplary embodiment. The angle brackets 902 extend out past the edges of the top of the I-beam, and the longitudinal threaded rods 904 extend past the end of the beam 400. The end brackets 906 cannot be seen in this view.

Figure 10:
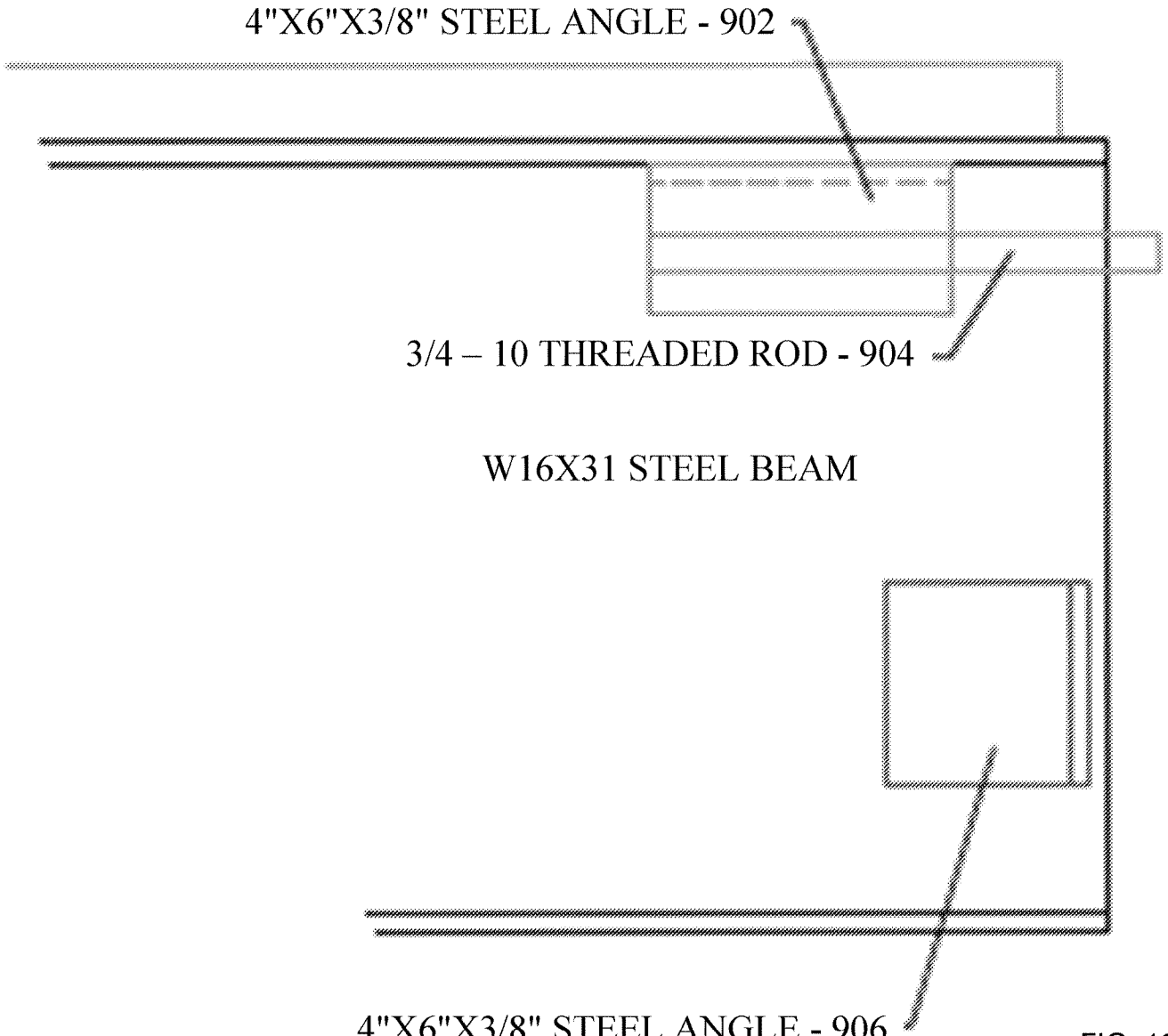
FIG. 10 is a schematic diagram showing a side view of the beam 400 of FIG. 8, in accordance with one exemplary embodiment.

FIG. 10 is a schematic diagram showing a side view of the beam 400 of FIG. 8, in accordance with one exemplary embodiment. Shown here is an angle bracket 902 with attached longitudinal threaded rod 904 and an end bracket 906. The longitudinal threaded rod 904 is configured to fit into the vertical channels 308 in a pair of lateral vertical brackets 304 in order to position and later secure the beam 400 onto the column 200, and the end brackets 906 are configured to abut the lateral vertical brackets 304 when the beam 400 is positioned so that the end brackets 906 can later be secured to the lateral vertical brackets 304.

Figure 11:
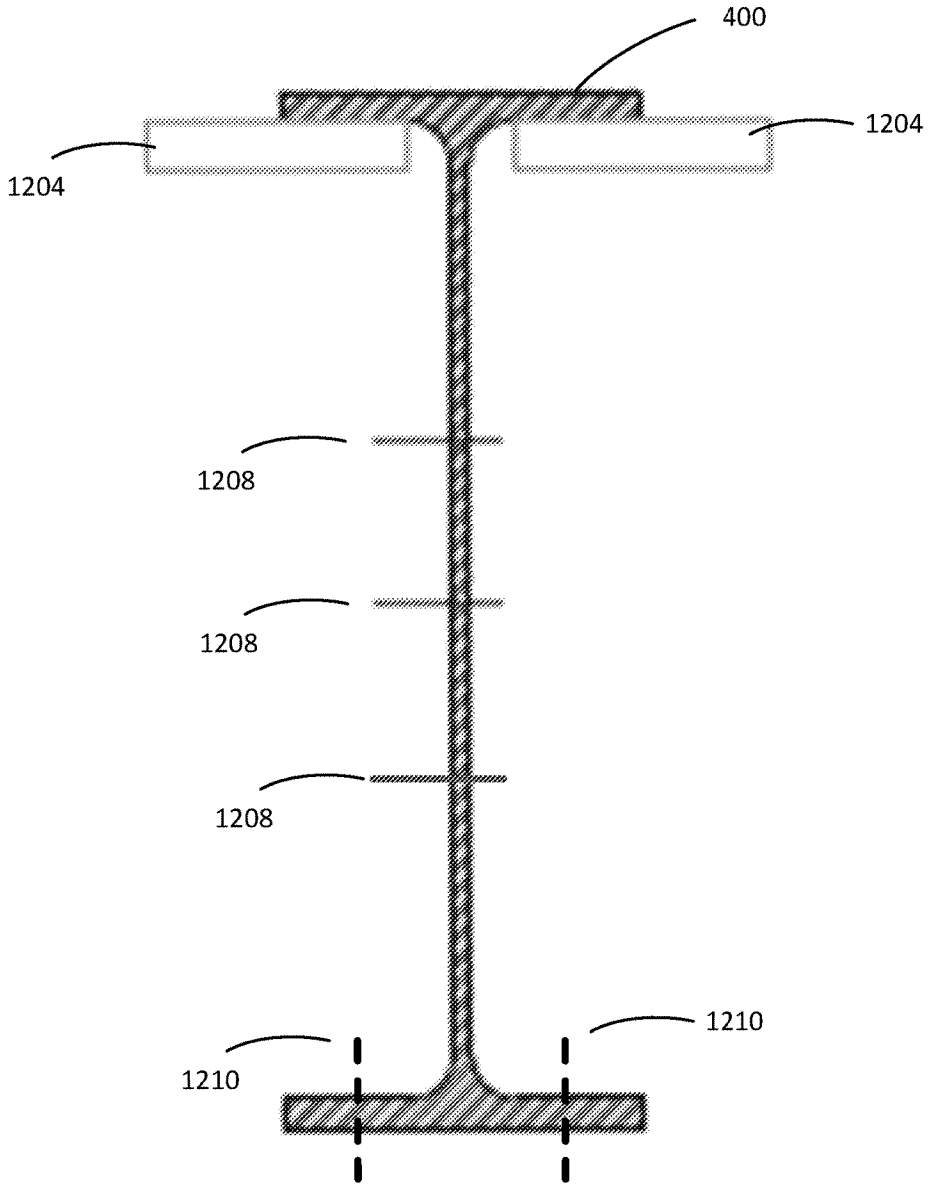
FIG. 11 is a schematic diagram showing an end view of a beam 400 having the second configuration (referred to herein as the lateral rod configuration), in accordance with one exemplary embodiment.

FIG. 11 is a schematic diagram showing an end view of a beam 400 having the second configuration (referred to herein as the lateral rod configuration), in accordance with one exemplary embodiment. Here, the beam 400 is an I-beam that includes two lateral threaded rods 1204 that extends past the side edges of the beam 400. These lateral threaded rods 904 fit into the vertical channels 308 in a pair of lateral vertical brackets 304 in order to position and later secure the beam 400 onto the column 200. The beam 400 also includes holes 1208 that align with corresponding holes in a central vertical plate 306 so that bolts can be placed through the holes for securing the beam 400 to the central vertical plate 304. The beam 400 also includes holes 1210 that align with corresponding holes in a horizontal plate 302 so that bolts can be placed through the holes for securing the beam 400 to the horizontal plate 302.

Figure 12:
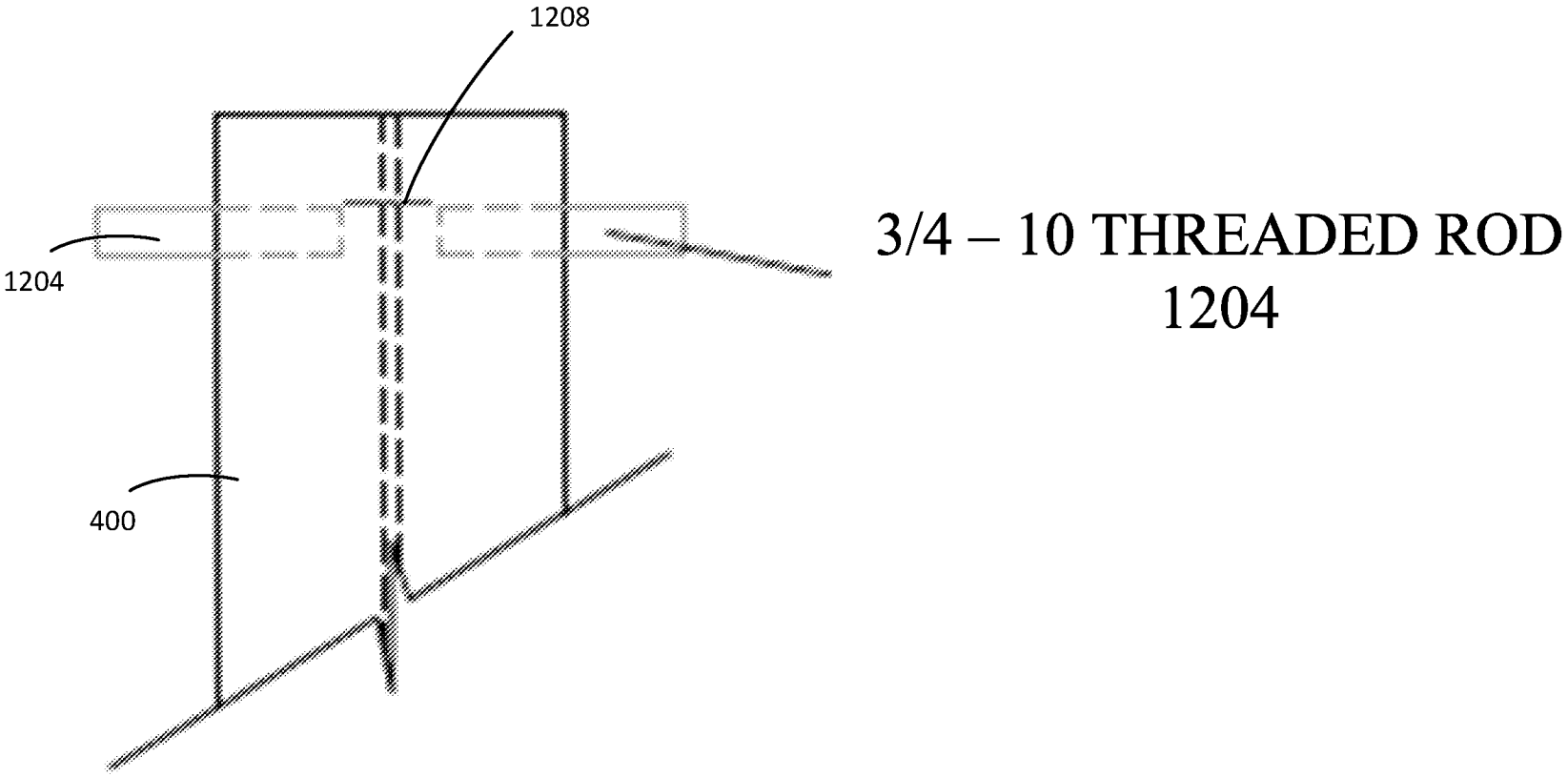
FIG. 12 is a schematic diagram showing a top view of the beam 400 of FIG. 11, in accordance with one exemplary embodiment.

FIG. 12 is a schematic diagram showing a top view of the beam 400 of FIG. 11, in accordance with one exemplary embodiment. The lateral threaded rods 1204 extend out past the edges of the top of the I-beam. The position of holes 1208 are shown.

Figure 13:
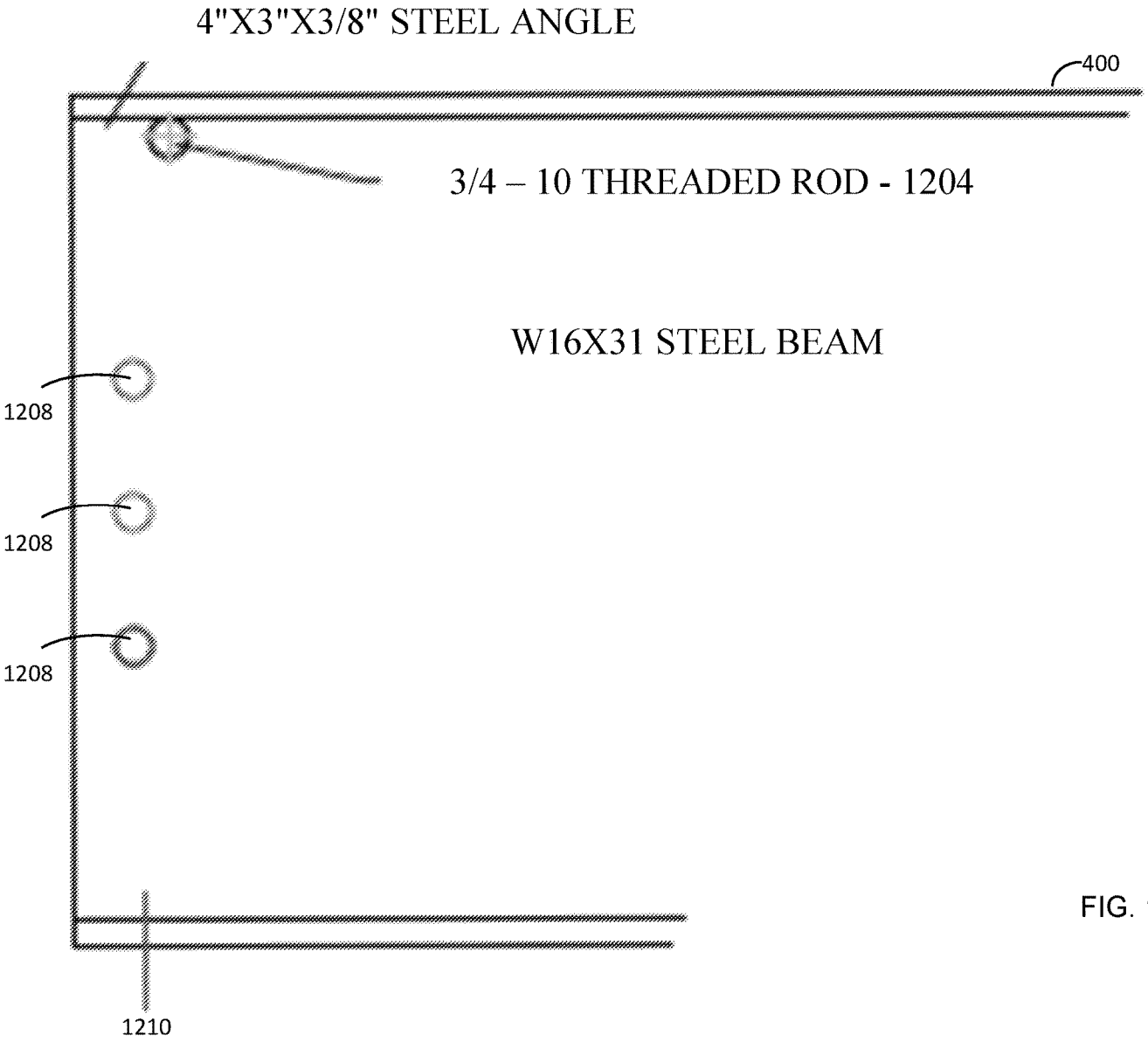
FIG. 13 is a schematic diagram showing a side view of the beam 400 of FIG. 11, in accordance with one exemplary embodiment.

FIG. 13 is a schematic diagram showing a side view of the beam 400 of FIG. 11, in accordance with one exemplary embodiment. Shown here is a lateral threaded rod 1204, three holes 1208 that align with corresponding holes in a central vertical plate 306 so that bolts can be placed through the holes for securing the beam 400 to the central vertical plate 304, and the location of a hole 1210 that aligns with a corresponding hole in a horizontal plate 302 so that a bolt can be placed through the holes for securing the beam 400 to the horizontal plate 302.

In this exemplary embodiment, beams with the longitudinal rod configuration as described with reference to FIGS. 8-10 are generally positioned and temporarily secured first and then beams with the lateral rod configuration as described with reference to FIGS. 11-13 are positioned and temporarily secured. Both the longitudinal rods 904 of the longitudinal rod configuration and the lateral rods 1204 of the lateral rod configuration are configured to fit into the same vertical channels 308 in a given set of lateral vertical brackets 304. The longitudinal rods 904 of the longitudinal rod configuration sit further below the top of the beam 400 than the lateral rods 1204 of the lateral rod configuration. Thus, when the beams 400 with the longitudinal rod configurations are positioned and temporarily secured and then the beams 400 with the lateral rod configurations are positioned and temporarily secured, the lateral rods 1204 will be positioned above the longitudinal rods 904 within the vertical channels 308. It should be noted that alternative embodiments could configure the lateral rods 1204 to be below the longitudinal rods, e.g., by placing the longitudinal threaded rods 904 higher on the angle brackets 902 and using additional brackets (not shown) to place the lateral threaded rods 1204 lower on the beam 400.

Figure 14:
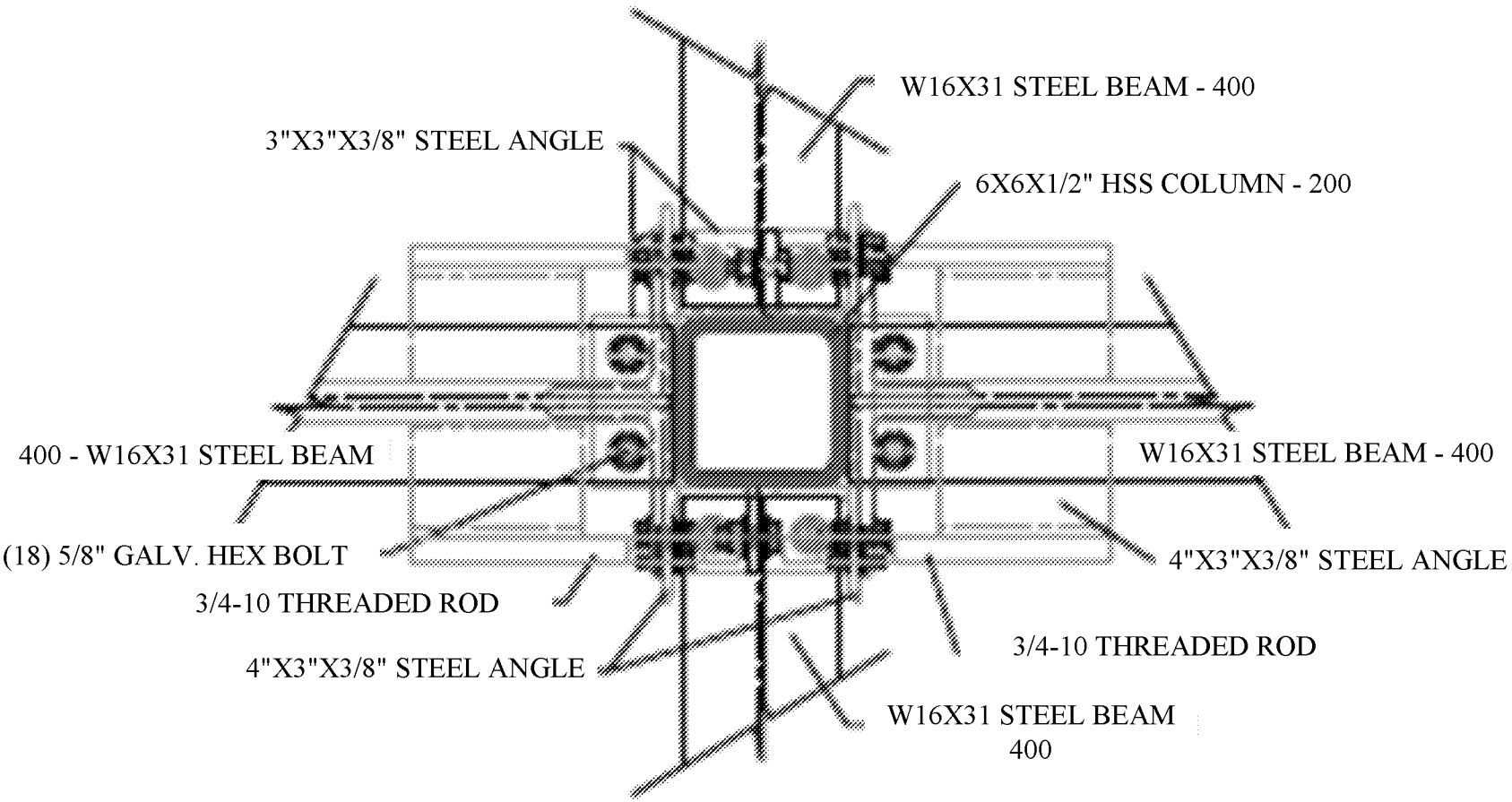
FIG. 14 is a schematic diagram showing a top view of a full column and beam assembly, in accordance with one exemplary embodiment.

FIG. 14 is a schematic diagram showing a top view of a full column and beam assembly, in accordance with one exemplary embodiment. Here four beams 400 (two having the longitudinal rod configuration and two having the lateral rod configuration) are attached to a column 200 using the various rods, brackets, plates, and nuts and bolts.

Figure 15:
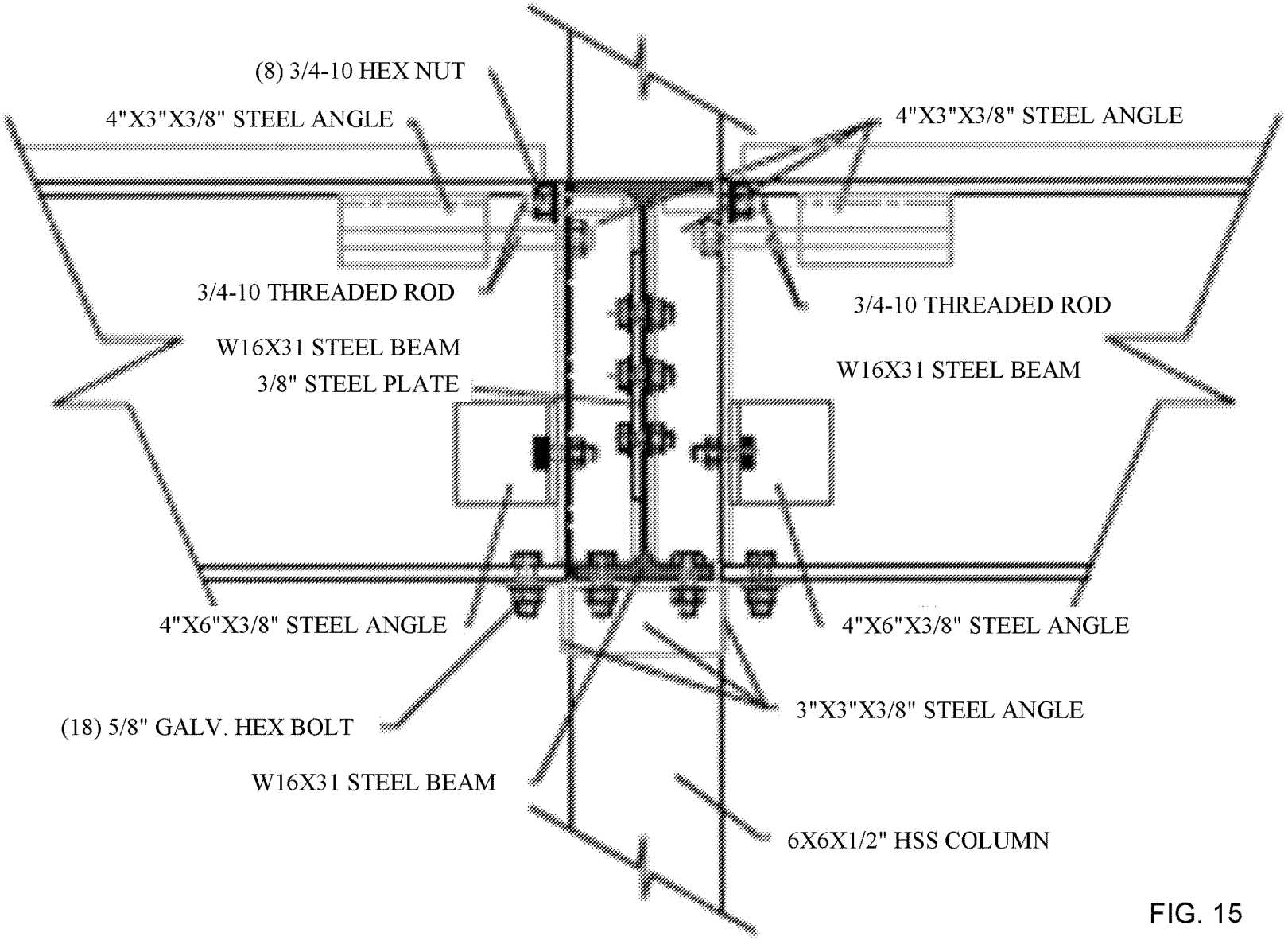
FIG. 15 is a schematic diagram showing a front side view of the full column and beam assembly of FIG. 14, in accordance with one exemplary embodiment.

FIG. 15 is a schematic diagram showing a front side view of the full column and beam assembly of FIG. 14, in accordance with one exemplary embodiment. It should be noted that the back side view of these components is virtually identical to the right side view in this exemplary embodiment. In this figure, it can be seen that the lateral rods 1204 are positioned above the longitudinal rods 904 within the vertical channels 308. Also, the lateral rods 1204 and the longitudinal rods 904 are secured within the vertical channels 308 using nuts that engage with the threaded rods. In this exemplary embodiment, the lateral rods 1204 and the longitudinal rods 904 are secured on opposite sides of the vertical channels 308, which helps to facilitate tightening of the nuts onto the threaded rods.

Figure 16:
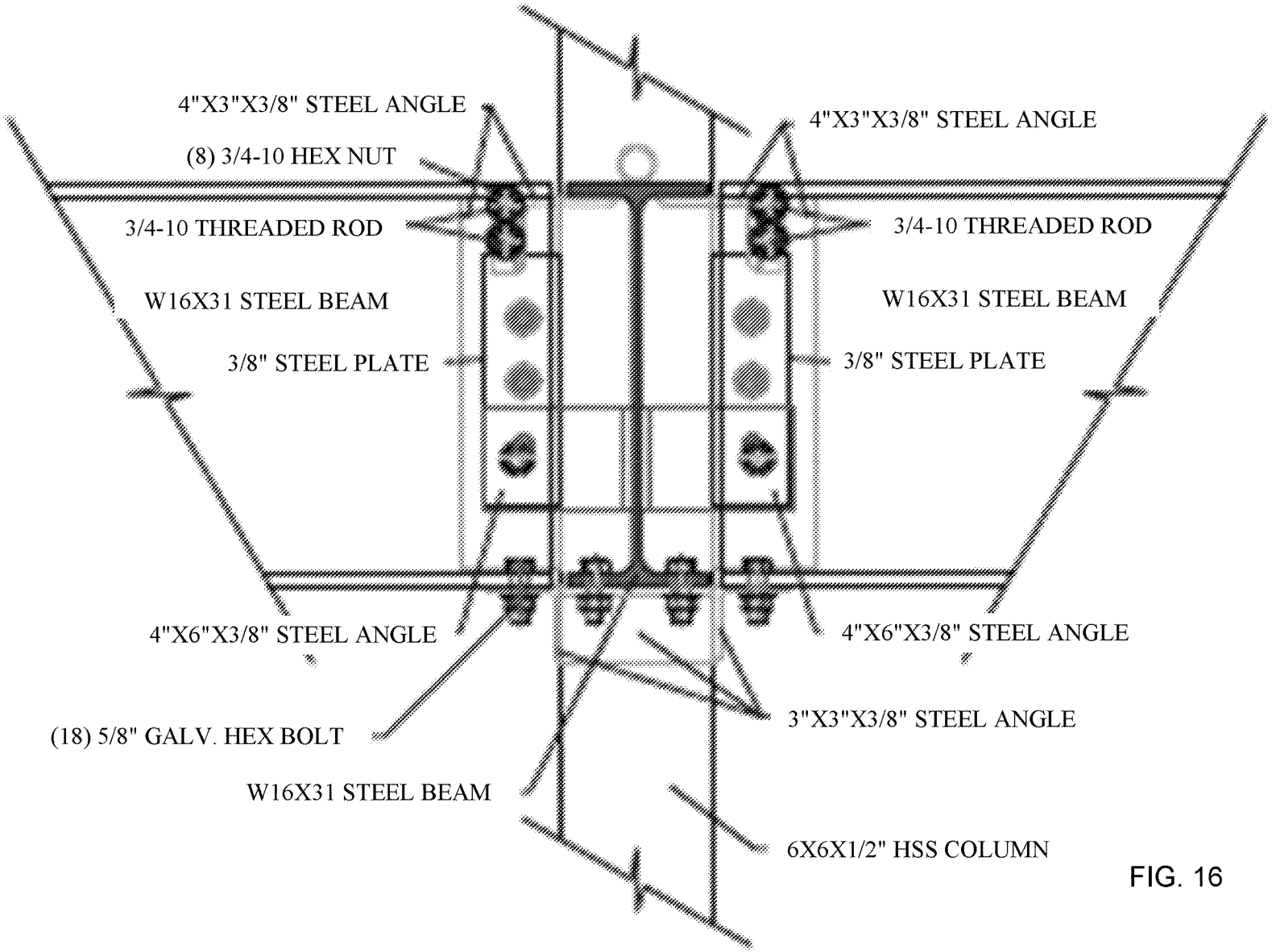
FIG. 16 is a schematic diagram showing a right side view of the full column and beam assembly of FIG. 14, in accordance with one exemplary embodiment.

FIG. 16 is a schematic diagram showing a right side view of the full column and beam assembly of FIG. 14, in accordance with one exemplary embodiment. It should be noted that the left side view of these components is virtually identical to the right side view in this exemplary embodiment.

An exemplary assembly process is now described with reference to the structures shown in FIG. 1. First, the pedestal bases 100 would be positioned. Then, columns 200 would be placed into the pedestal bases 100 with the rod cross-brace brackets 208 facing the corresponding rod cross-brace brackets 108 on the opposite pedestal bases. One or both of the columns 200 may be shimmed, e.g., for leveling. Bolts 112 on the pedestal bases 100 generally would be tightened sufficiently to provide at least temporary support of the columns 200, e.g., to ensure that they are at least substantially vertical. Then, threaded rods with appropriate keys at each end would be inserted into opposing pairs of rod cross-brace brackets 108/208 and tightened sufficiently to provide at least temporary support of the columns 200. Another similar structure generally would be assembled, with the solid cross-brace brackets 210 on the columns 200 facing the corresponding solid cross-brace brackets 110 on the opposite pedestal bases 100. Solid cross-brace members would be installed on opposing pairs of solid cross-brace brackets 110/210 and tightened sufficiently to provide at least temporary support of the columns 200. In essence, two interconnected structures of the type shown in FIG. 1 form a rectangular (e.g., square) arrangement of columns 200. Generally speaking, all pedestal bases 100 and columns 200 for a particular installation (or section of an installation) would be positioned and assembled prior to installation of beams 400 in the manner discussed above. Once the pedestal bases 100, columns 200, rod cross-braces, solid cross-braces, and beams 400 have been assembled, adjustments can be made (e.g., to level the structure including the addition of shims if needed, and to ensure that all columns 200 are vertical) and then all temporary connections can be tightened (e.g., tightening the rod cross-braces, the solid cross-braces, and all bolts).

The columns 200 and beams 400 at a particular tier can support additional structures, such as, without limitation, an additional tier of columns and beams or aluminum bleacher seating.

Figure 17:
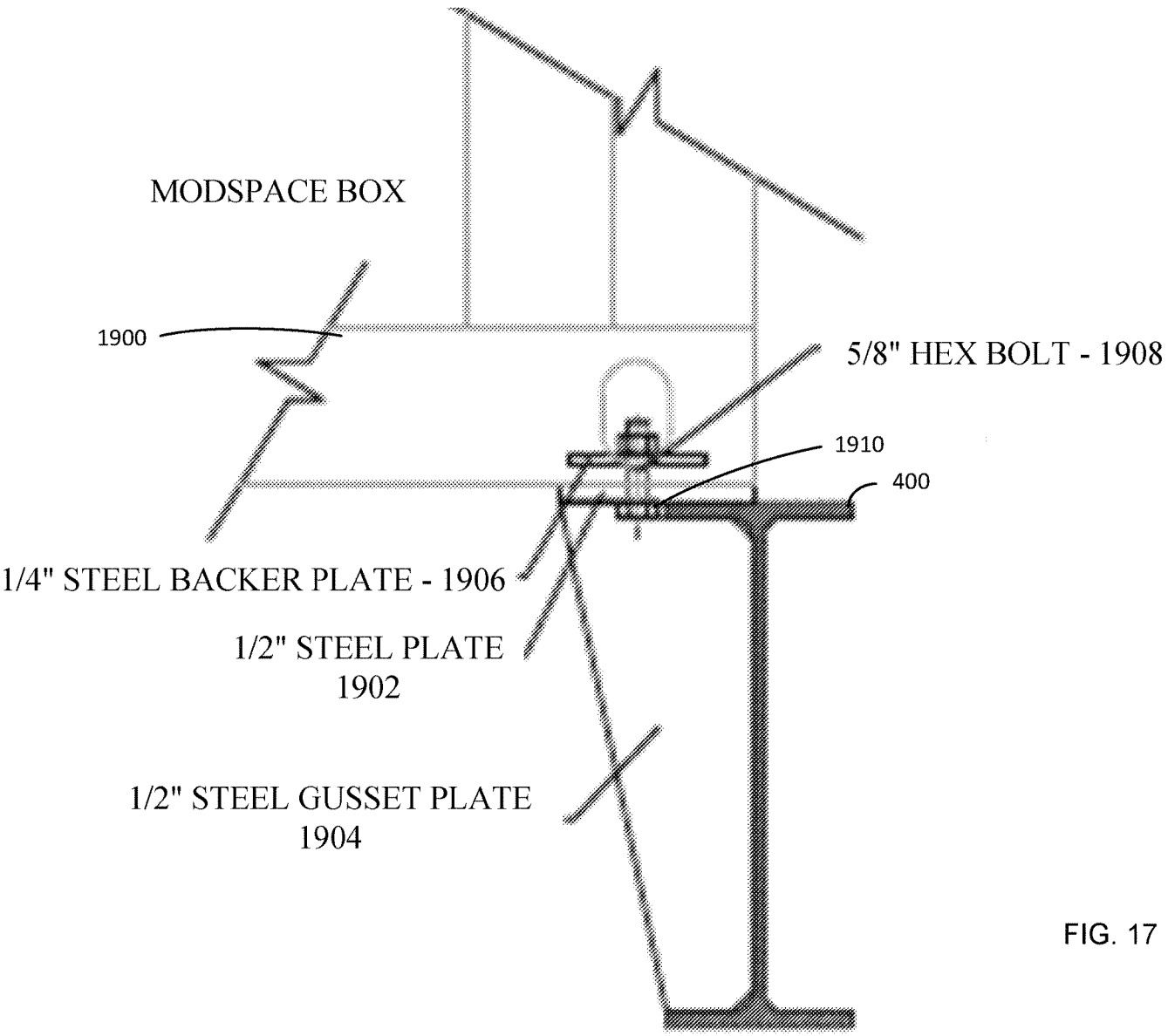
FIG. 17 is a schematic diagram showing an end view of a beam 400 including a modspace box for attaching a cross-beam 1900 to the beam 400, in accordance with one exemplary embodiment.
Figure 18:
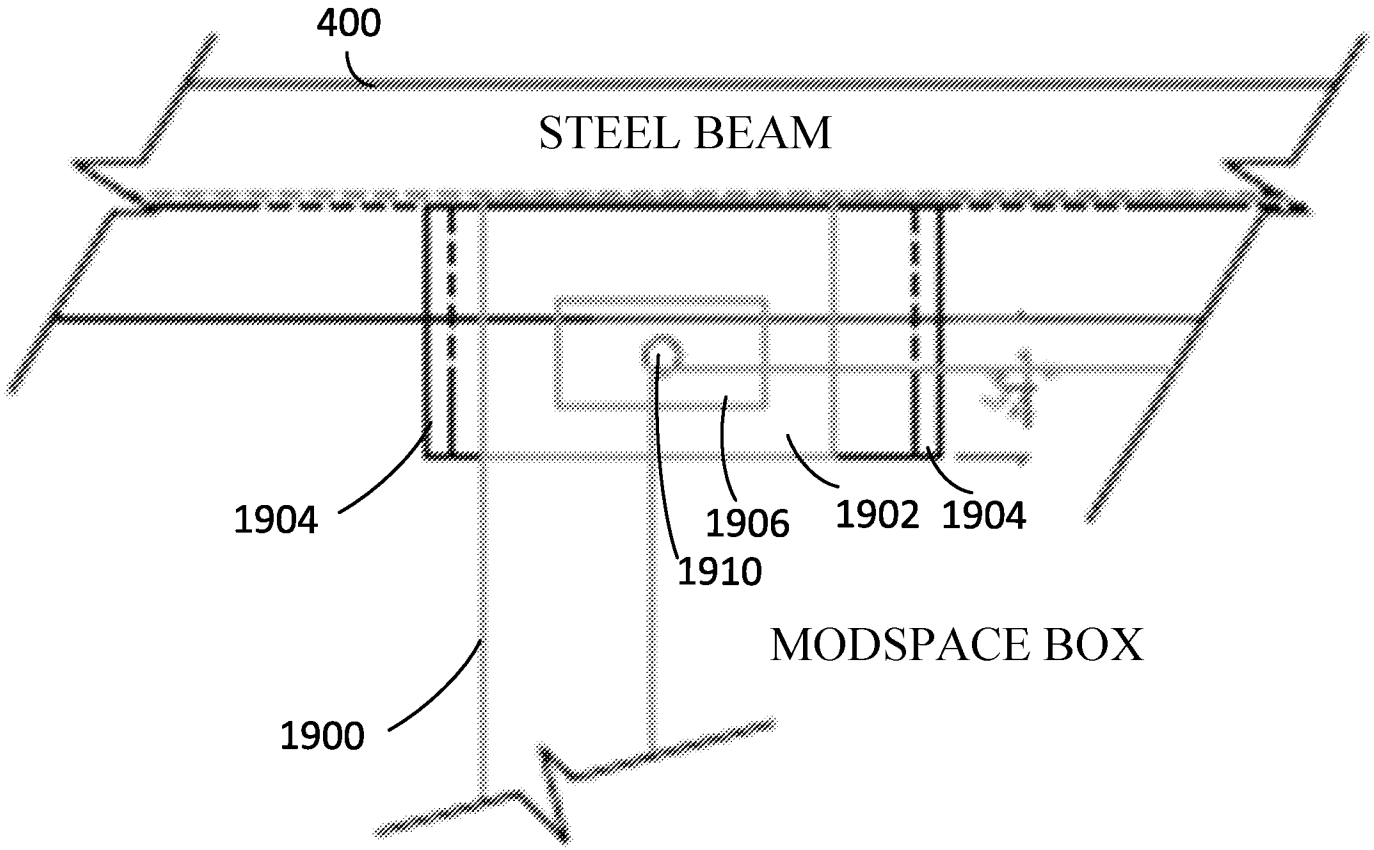
FIG. 18 is a schematic diagram showing a top view of the beam 400 including the modspace box of FIG. 17, in accordance with one exemplary embodiment.
Figure 19:
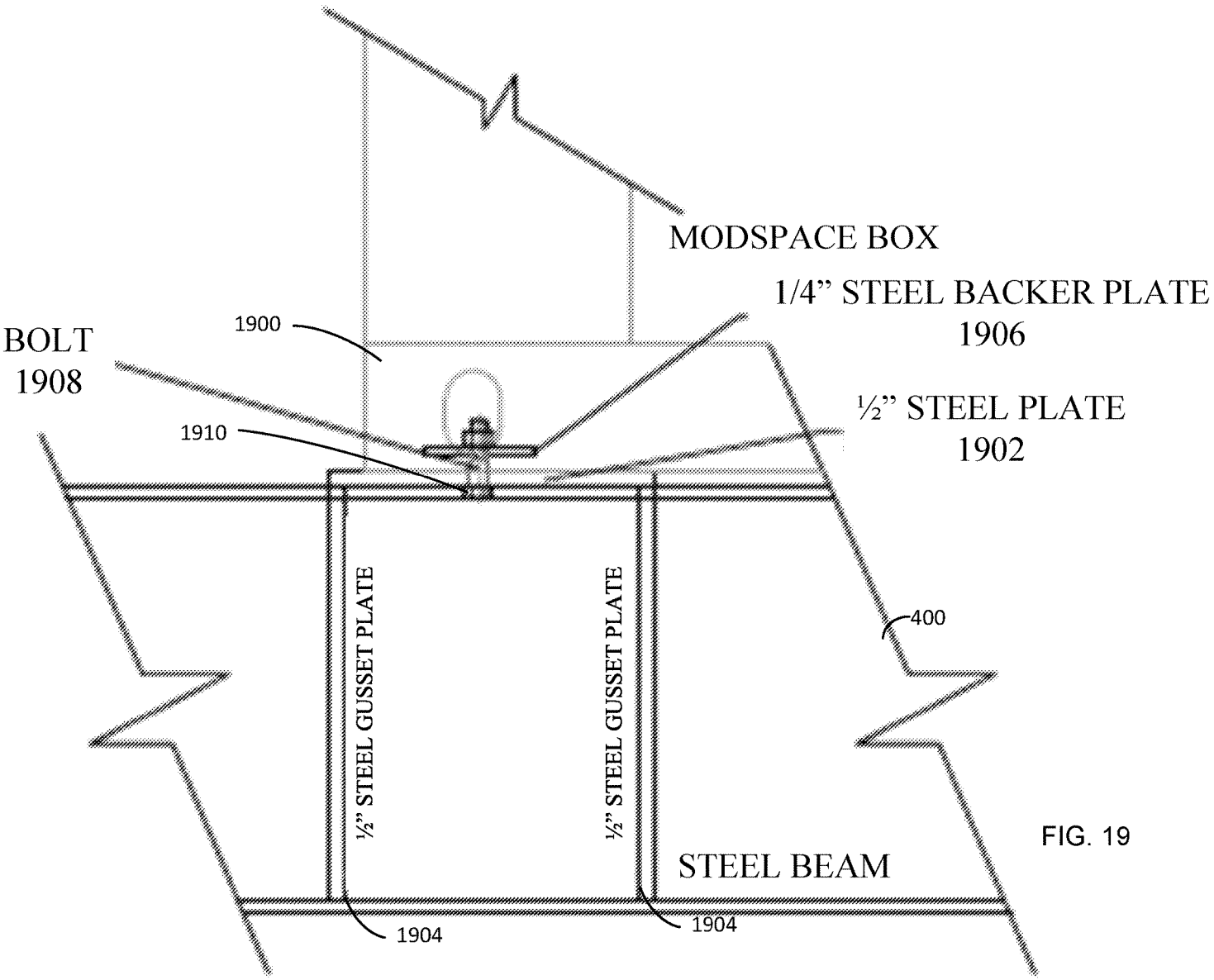
FIG. 19 is a schematic diagram showing a side view of the beam 400 including the modspace box of FIG. 17, in accordance with one exemplary embodiment.

FIGS. 17-19 are schematic diagrams showing a support structure (sometimes referred to herein as a modspace box) that can be used, without limitation, for attaching a cross-beam or other component to a beam 400, in accordance with one exemplary embodiment.

FIG. 17 is a schematic diagram showing an end view of a beam 400 including a modspace box for attaching a cross-beam 1900 to the beam 400, in accordance with one exemplary embodiment. The modspace box includes a top plate 1902 attached to the top of the I-beam 400 and extending out past the edge of the I-beam 400. In this exemplary embodiment, the top plate 1902 is supported by two gusset plates 1904 attached to the side of the I-beam 400, although the top plate 1902 could be supported in other ways. A hole 1910 in the top plate 1902 is used, along with a backer plate 1906 and a bolt 1908, to secure the cross-beam 1900 to the beam 400. In this example, the cross-beam 1900 is an aluminum box tube that is secured to the modspace box by a bolt from inside of the box tube. The box tube includes at least one opening to allow access to the bolt, e.g., to allow for tightening and loosening the bolt.

FIG. 18 is a schematic diagram showing a top view of the beam 400 including the modspace box of FIG. 17, in accordance with one exemplary embodiment. This view shows the placement of the top plate 1902 and gusset plates 1904 on the I-beam 400. This view also shows the relative placement of the backer plate 1906 and hole 1910.

FIG. 19 is a schematic diagram showing a side view of the beam 400 including the modspace box of FIG. 17, in accordance with one exemplary embodiment. This view shows the placement of the top plate 1902 and gusset plates 1904 on the I-beam 400. This view also shows the relative placement of the backer plate 1906 and hole 1910.

Figure 20:
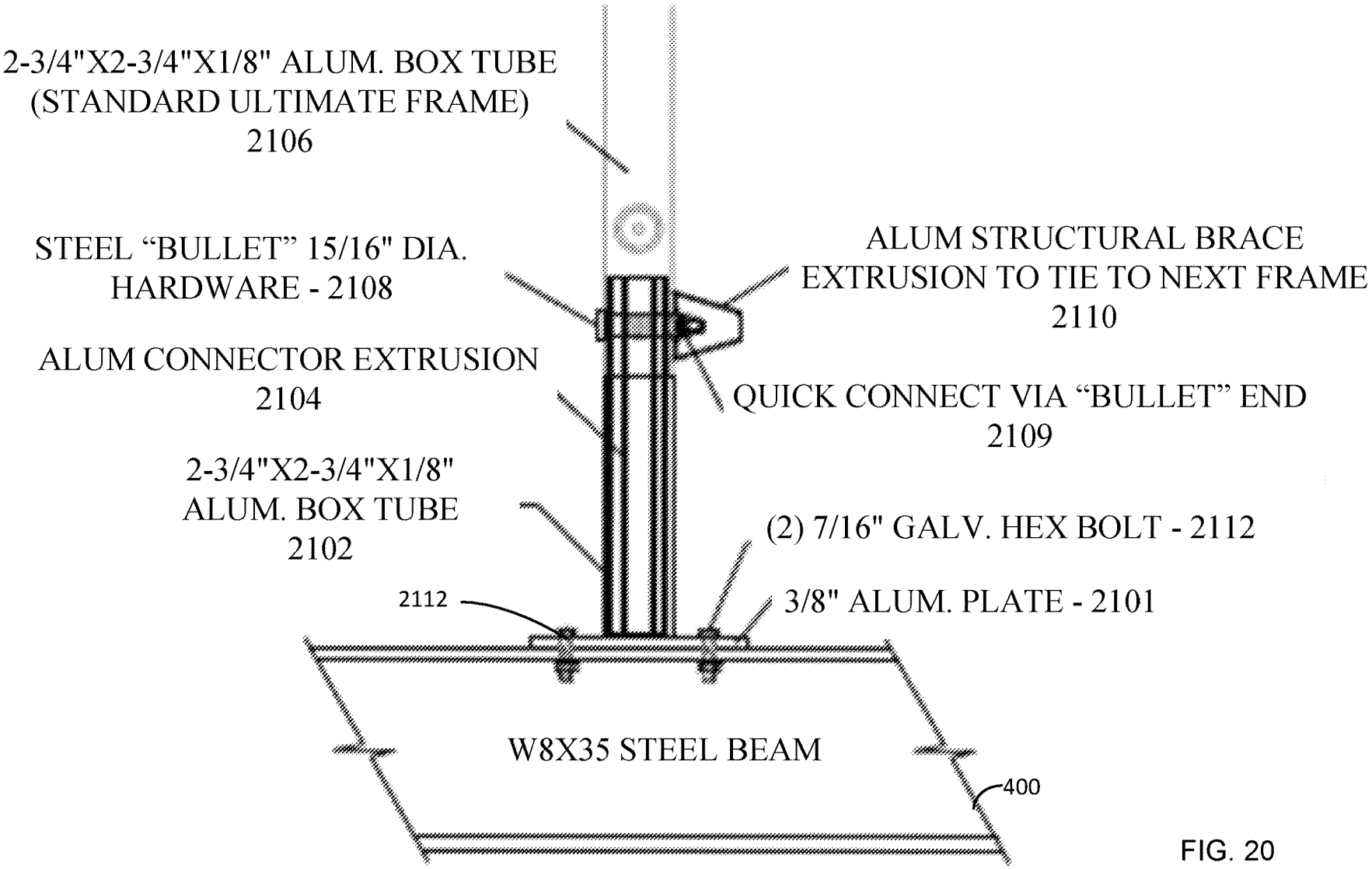
FIG. 20 is a schematic diagram showing a side view of the beam and support structure, in accordance with one exemplary embodiment.
Figure 21:
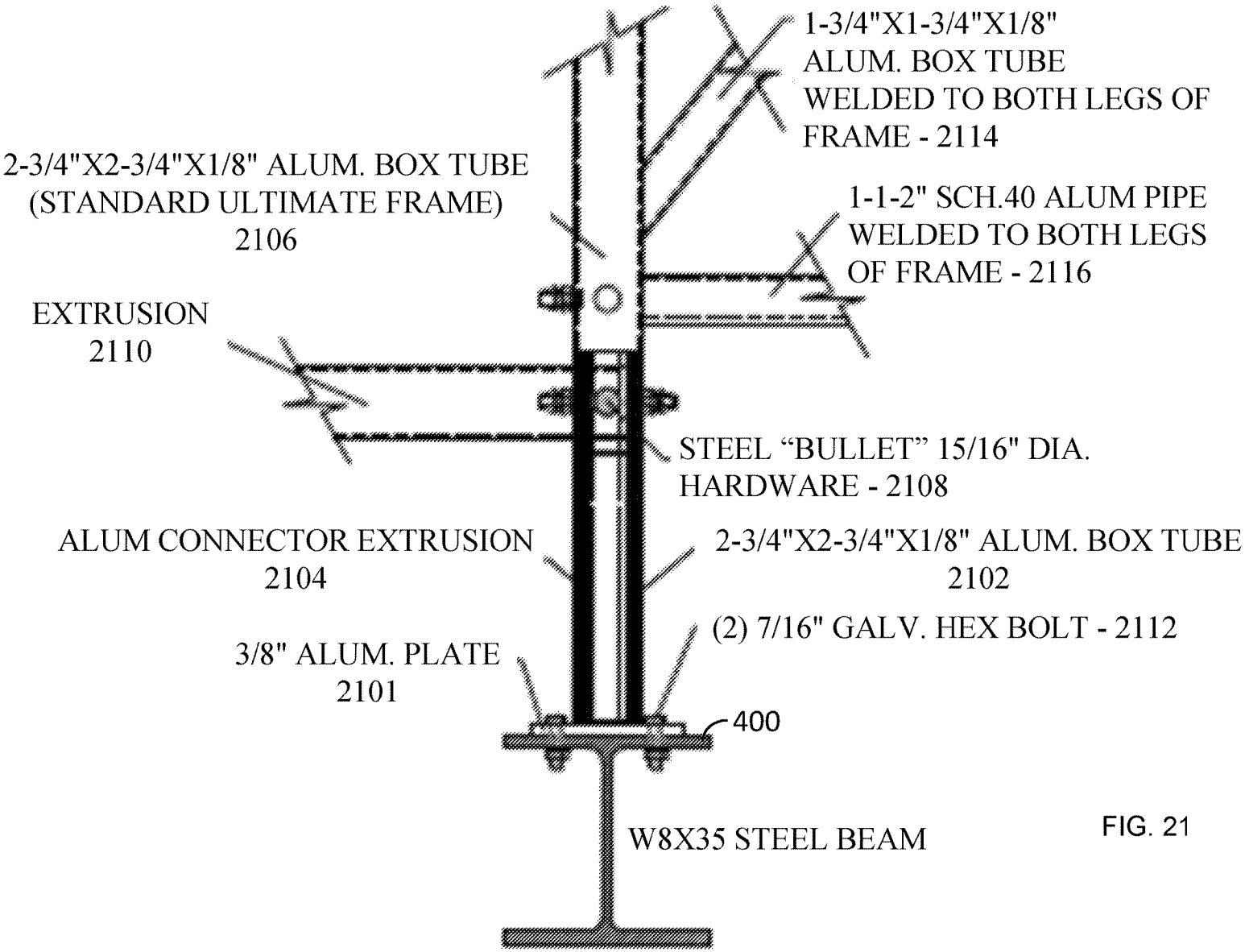
FIG. 21 is a schematic diagram showing an end view of the beam and support structure of FIG. 20, in accordance with one exemplary embodiment.
Figure 22:
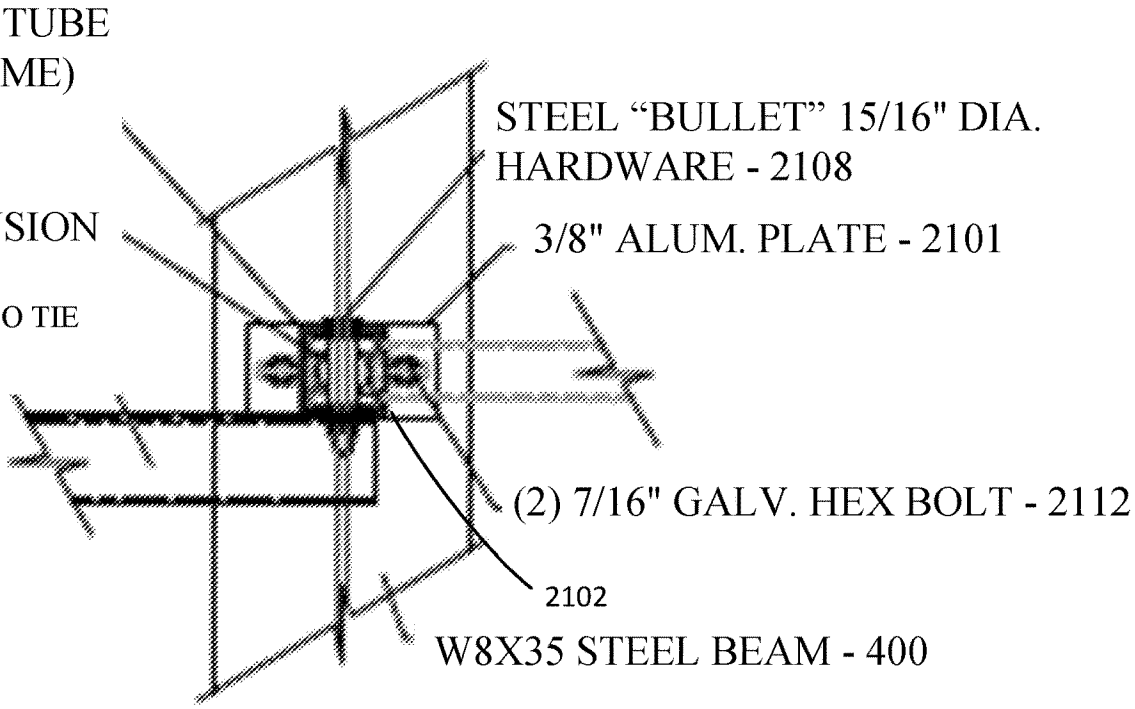
FIG. 22 is a schematic diagram showing a top view of the beam and support structure of FIG. 20, in accordance with one exemplary embodiment.

FIGS. 20-22 are schematic diagrams showing a box tube support structure that can be used, without limitation, for attaching a standard ultimate frame box tube to a beam 400, in accordance with one exemplary embodiment.

FIG. 20 is a schematic diagram showing a side view of the beam and support structure, in accordance with one exemplary embodiment. Among other things, the support structure includes a base plate 2101 (e.g., an aluminum or steel plate) to which is attached an outer box tube 2102 and an inner connector extrusion 2104 that extends above the outer box tube 2102. The box tube 2106 to be attached to the beam 400 (e.g., a standard ultimate frame box tube) is able to slide over the inner connector extrusion 2104 until it abuts the outer box tube 2102. The box tube 2106 can then be secured to the support structure (in this example, to the inner connector extrusion 2104) using an appropriate connector 2108, which, in this example, includes a steel "bullet" that passes through two sides of the box tube 2106 and the inner connector extrusion 2104. In this example, a brace 2110 is also attached to the box tube 2106 via the connector 2108. The brace 2110 may connect to an adjacent frame element, e.g., for strength and stability. The support structure attaches to the beam via bolts 2112.

FIG. 21 is a schematic diagram showing an end view of the beam and support structure of FIG. 20, in accordance with one exemplary embodiment. Shown here are the base plate 2101, the outer box tube 2102, the inner connector extrusion 2104, the box tube 2106 and the brace 2110 attached to the support structure via connector 2108, and the bolts 2112 attaching the support structure to the beam 400. Also shown here are additional supports 2114 and 2116 that are welded to the box tube 2106.

FIG. 22 is a schematic diagram showing a top view of the beam and support structure of FIG. 20, in accordance with one exemplary embodiment. Shown here are the base plate 2101, the outer box tube 2102, the inner connector extrusion 2104, the box tube 2106 and the brace 2110 attached to the support structure via connector 2108, and the bolts 2112 attaching the support structure to the beam 400.

It should be noted that the support structure of the type described with reference to FIGS. 20-22 can be configured to support columns of the type described with reference to FIGS. 1-7 and can be configured with rod cross-brace brackets 108 and/or solid cross-brace brackets 110 for use with such columns as described above.

It should be noted that various elements described above can be used alone or together in different ways in different alternative embodiments. For example, pedestal bases of the type describe above with reference to FIGS. 1-4 can be used with columns that do not have connection components of the type described with reference to FIGS. 5-7. Columns that include connection components of the type described with reference to FIGS. 5-7 can be used with different types of pedestal bases (e.g., pedestal bases 100, support structures of the type described with reference to FIGS. 20-22, or other bases) or with no bases (e.g., placed directly in the ground or in cement). Components can be configured in different sizes, e.g., different sized columns, beams, etc. Components can be configured in different materials, e.g., steel or aluminum.

Various embodiments of the present invention may be characterized by the potential claims listed in the paragraphs following this paragraph (and before the actual claims provided at the end of the application). These potential claims form a part of the written description of the application. Accordingly, subject matter of the following potential claims may be presented as actual claims in later proceedings involving this application or any application claiming priority based on this application. Inclusion of such potential claims should not be construed to mean that the actual claims do not cover the subject matter of the potential claims. Thus, a decision to not present these potential claims in later proceedings should not be construed as a donation of the subject matter to the public.

Without limitation, potential subject matter that may be claimed (prefaced with the letter "P" so as to avoid confusion with the actual claims presented below) includes:

P1. A pedestal base for a freestanding construction system, the pedestal base comprising:

a base plate;

a column support attached to the base plate; and at least one rod cross-brace bracket on the column support, each cross-brace bracket including a keyed slot configured to receive a key portion of a threaded rod cross-brace member.

P2. A pedestal base according to claim P1, comprising two rod cross-brace brackets on opposing sides of the column support.

P3. A pedestal base according to claim P1, further comprising at least one solid cross-brace bracket on the column support.

P4. A pedestal base according to claim P3, comprising two solid cross-brace brackets on opposing sides of the column support.

P5. A pedestal base according to claim P1 substantially as shown and described with reference to FIGS. 2-4.

P6. A pedestal base according to any of claims P1-P5, wherein the column support is configured to support a square column.

P7. A pedestal base according to any of claims P1-P5, wherein the column support is configured to support a round column.

P8. A column assembly for a freestanding construction system, the column comprising:

a column; and at least one rod cross-brace bracket on the column, each cross-brace bracket including a keyed slot configured to receive a key portion of a threaded rod cross-brace member.

P9. A column assembly according to claim P8, comprising two rod cross-brace brackets on opposing sides of the column.

P10. A column assembly according to claim P8, further comprising at least one solid cross-brace bracket on the column.

P11. A column assembly according to claim P10, comprising two solid cross-brace brackets on opposing sides of the column.

P12. A column assembly according to claim P8, comprising two rod cross-brace brackets on opposing sides of the column and two solid cross-brace brackets on opposing sides of the column.

P13. A column assembly according to any of claims P8-P12, wherein the column is a square column.

P14. A column assembly according to any of claims P8-P12, wherein the column is a round column.

P15. A column assembly for a construction system, the column assembly comprising:

a column;

two lateral vertical plates on the column configured to interface with a beam having a longitudinal rod configuration.

P16. A column assembly according to claim P15, wherein each vertical plate includes at least one hole for attaching the beam to the vertical plates.

P17. A column assembly according to any of claims P15-P16, further comprising a horizontal plate on the column for at least one of (a) supporting the beam or (b) attaching the beam to the horizontal plate.

P18. A column assembly for a construction system, the column assembly comprising:

a column;

two lateral vertical plates on the column configured to interface with a beam having a lateral rod configuration.

P19. A column assembly according to claim P18, further comprising:

a central vertical plate on the column between the two lateral vertical plates, the central vertical plate including holes for attaching the beam to the central vertical plate.

P20. A column assembly according to any of claims P18-P19, further comprising a horizontal plate on the column for at least one of (a) supporting the beam or (b) attaching the beam to the horizontal plate.

P21. A beam assembly comprising:

a beam;

a longitudinal rod configuration on the beam.

P22. A beam assembly according to claim P21, wherein the longitudinal rod configuration comprises:

a first angle bracket attached to a first side of the beam;

a first longitudinal rod attached to the first angle bracket;

a second angle bracket attached to a second side of the beam opposite the first side; and a second longitudinal rod attached to the second angle bracket.

P23. A beam assembly according to any of claims P21-P22, further comprising:

a first end bracket attached to the first side of the beam; and a second end bracket attached to the second side of the beam, wherein each end bracket includes at least one hole for attaching the end bracket to a corresponding lateral vertical plate on a column.

P24. A beam assembly comprising:

a beam; and a lateral rod configuration on the beam.

P25. A beam assembly according to claim P24, wherein the lateral rod configuration comprises:

a first lateral rod attached to a first side of the beam; and a second lateral rod attached to a second side of the beam opposite the first side.

Although the above discussion discloses various exemplary embodiments of the invention, it should be apparent that those skilled in the art can make various modifications that will achieve some of the advantages of the invention without departing from the true scope of the invention. Any references to the "invention" are intended to refer to exemplary embodiments of the invention and should not be construed to refer to all embodiments of the invention unless the context otherwise requires. The described embodiments are to be considered in all respects only as illustrative and not restrictive.

What is claimed is:

1. Apparatus for a freestanding construction system, the apparatus comprising:

a column;

at least one rod cross-brace bracket on the column, the at least one rod cross-brace bracket including a keyed slot configured to receive a key portion of a threaded rod cross-brace member;

two lateral vertical plates on the column configured to interface with a beam having a longitudinal rod configuration; and a horizontal plate on the column for at least one of (a) supporting the beam or (b) attaching the beam to the horizontal plate.

2. The apparatus of claim 1, wherein the at least one rod cross-brace bracket comprises two rod cross-brace brackets on opposing sides of the column.

3. The apparatus of claim 1, further comprising at least one solid cross-brace bracket on the column.

4. The apparatus of claim 3, wherein the at least one solid cross-brace bracket comprises two solid cross-brace brackets on opposing sides of the column.

5. The apparatus of claim 1, wherein the at least one rod cross-brace bracket is an angle bracket.

6. The apparatus of claim 1, further comprising: a base plate comprising a column support configured to receive the column, wherein the column support comprises: at least one rod cross-brace bracket on the column support, the at least one rod cross-brace bracket including a keyed slot configured to receive a key portion of a threaded rod cross-brace member; at least one notch configured to allow insertion of a shim under the column; or at least one adjustment nut into which a bolt can be threaded in order to secure the column in the column support.

7. The apparatus of claim 1, wherein each of the two lateral vertical plates includes at least one hole for attaching the beam to the two lateral vertical plates.

8. Apparatus for a freestanding construction system, the apparatus comprising:

a beam; and a longitudinal rod configuration on the beam configured to interface with two lateral vertical plates on a column configured to interface with the longitudinal rod configuration, the longitudinal rod configuration comprising a first angle bracket attached to a first side of the beam, a first longitudinal rod attached to the first angle bracket, a second angle bracket attached to a second side of the beam opposite the first side, and a second longitudinal rod attached to the second angle bracket;

wherein the longitudinal rod configuration further comprises:

a first end bracket attached to the first side of the beam; and a second end bracket attached to the second side of the beam, wherein each of the first and second end brackets includes at least one hole for attaching the first and second end brackets to a corresponding lateral vertical plate on a column.

9. Apparatus for a freestanding construction system, the apparatus comprising:

a column;

at least one rod cross-brace bracket on the column, the at least one rod cross-brace bracket including a keyed slot configured to receive a key portion of a threaded rod cross-brace member;

two lateral vertical plates on the column configured to interface with a beam having a lateral rod configuration; and a central vertical plate on the column between the two lateral vertical plates, the central vertical plate including holes for attaching the beam to the central vertical plate.

10. The apparatus of claim 9, wherein the at least one rod cross-brace bracket comprises two rod cross-brace brackets on opposing sides of the column.

11. The apparatus of claim 9, further comprising at least one solid cross-brace bracket on the column.

12. The apparatus of claim 11, wherein the at least one solid cross-brace bracket comprises two solid cross-brace brackets on opposing sides of the column.

13. The apparatus of claim 9, wherein the at least one rod cross-brace bracket is an angle bracket.

14. The apparatus of claim 9, further comprising: a base plate comprising a column support configured to receive the column, wherein the column support comprises: at least one rod cross-brace bracket on the column support, the at least one rod cross-brace bracket including a keyed slot configured to receive a key portion of a threaded rod cross-brace member; at least one notch configured to allow insertion of a shim under the column; or at least one adjustment nut into which a bolt can be threaded in order to secure the column in the column support.

15. Apparatus for a freestanding construction system, the apparatus comprising:

a column;

at least one rod cross-brace bracket on the column, the at least one rod cross-brace bracket including a keyed slot configured to receive a key portion of a threaded rod cross-brace member;

two lateral vertical plates on the column configured to interface with a beam having a lateral rod configuration; and a horizontal plate on the column for at least one of (a) supporting the beam or (b) attaching the beam to the horizontal plate.

16. The apparatus of claim 15, wherein the at least one rod cross-brace bracket comprises two rod cross-brace brackets on opposing sides of the column.

17. The apparatus of claim 15, further comprising at least one solid cross-brace bracket on the column.

18. The apparatus of claim 17, wherein the at least one solid cross-brace bracket comprises two solid cross-brace brackets on opposing sides of the column.

19. The apparatus of claim 15, wherein the at least one rod cross-brace bracket is an angle bracket.

20. The apparatus of claim 15, further comprising: a base plate comprising a column support configured to receive the column, wherein the column support comprises: at least one rod cross-brace bracket on the column support, the at least one rod cross-brace bracket including a keyed slot configured to receive a key portion of a threaded rod cross-brace member; at least one notch configured to allow insertion of a shim under the column; or at least one adjustment nut into which a bolt can be threaded in order to secure the column in the column support.

* * * * *